US011254486B2

(12) United States Patent
Flores

(10) Patent No.: US 11,254,486 B2
(45) Date of Patent: Feb. 22, 2022

(54) APPARATUS FOR DISPENSING OBJECTS AND METHOD

(71) Applicant: Sebastian Javier Flores, Alpharetta, GA (US)

(72) Inventor: Sebastian Javier Flores, Alpharetta, GA (US)

( * ) Notice: Subject to any disclaimer, the term of this patent is extended or adjusted under 35 U.S.C. 154(b) by 133 days.

(21) Appl. No.: 16/889,802

(22) Filed: Jun. 2, 2020

(65) Prior Publication Data

US 2020/0385197 A1 Dec. 10, 2020

Related U.S. Application Data

(60) Provisional application No. 62/858,508, filed on Jun. 7, 2019.

(51) Int. Cl.
*B65D 83/04* (2006.01)
*B42D 15/04* (2006.01)

(52) U.S. Cl.
CPC ..... *B65D 83/04* (2013.01); *B42D 15/045* (2013.01)

(58) Field of Classification Search
None
See application file for complete search history.

(56) References Cited

U.S. PATENT DOCUMENTS

| | | | | | |
|---|---|---|---|---|---|
| 2,156,999 | A * | 5/1939 | McNeil | B65D 5/02 | 229/109 |
| 3,638,851 | A * | 2/1972 | Offer | B65D 5/02 | 206/446 |
| 4,793,546 | A * | 12/1988 | Nunn | B65D 5/02 | 229/109 |
| 5,372,269 | A * | 12/1994 | Sutton | B65D 3/04 | 220/4.09 |
| 7,743,972 | B2 * | 6/2010 | Fogle | B65D 71/36 | 229/120.18 |
| 2011/0111938 | A1 * | 5/2011 | Smith | B65D 5/4608 | 493/162 |

* cited by examiner

*Primary Examiner* — Gene O Crawford
*Assistant Examiner* — Ayodeji T Ojofeitimi
(74) *Attorney, Agent, or Firm* — Steven C. Stewart

(57) ABSTRACT

An apparatus for dispensing small objects is disclosed. The apparatus includes a frame forming an upper chamber and a lower chamber. The frame supports a rotatable barrel that is disposed between the chambers. The barrel is constructed from a folded rectangular sheet that forms a chamber with an opening. The rotatable barrel is oriented with the opening facing upward to receive objects from the upper chamber into the barrel's chamber, such that when the handle is rotated about a horizontal axis the barrel turns to orient the opening downward and deposit objects in the barrel's chamber into the lower chamber.

15 Claims, 25 Drawing Sheets

400

402

600

APPARATUS FOR DISPENSING OBJECTS AND METHOD

TECHNICAL FIELD

These claimed embodiments relate to a device and method for dispensing small objects.

BACKGROUND OF THE INVENTION

An apparatus for holding a dispensing small object is disclosed.

Devices have been made for storing objects to prevent particles and dust from collecting on the objects. These devices can then dispense the objects by use of a slide panel or mechanism that revolves horizontally around a center axis to dispense the small object.

These devices typically have a chamber to store the objects before being dispensed. Further these dispensers are typically constructed from glass and metal. These materials are formed by placing hot parts into a mold, or by placing smaller parts into many molds and then connecting the parts together. The process to make these devices can be both time consuming and expensive.

SUMMARY OF THE INVENTION

The present invention relates to a device and method for dispensing objects.

One general aspect includes a method for making an apparatus to dispense objects. The method also includes providing a frame having a left-side wall, a right-side wall, a front wall and a back wall, the frame enclosing an upper chamber and a lower chamber, and forming opposing apertures on the front wall and the back wall between the upper chamber and the lower chamber. The method also includes forming a trough by folding a rectangular sheet of material with a short side and a long side, the rectangular sheet having long edges formed along the long sides and short edges formed along the short sides, the rectangular sheet integrated with a plurality of front tabs extending outward from the rectangular sheet along one of the long edges and with a plurality of rear tabs extending outward from the rectangular sheet along another of the long edges. The method also includes providing a first and a second circular disk having an outside surface and an inside surface, the first circular disk having a plurality of slots that receive the front tabs on the first circular disk inside surface, and the second circular disk having a plurality of slots that receive the rear tabs on the second circular disk inside surface, the first and second circular disk forming with the trough a rotatable barrel with a barrel chamber and an opening. The method also includes connecting a handle to at least one of the circular disks outside surface to rotate the rotatable barrel. The method also includes disposing the rotatable barrel in the aperture with the first circular disk disposed outside of the front wall and the second circular disk disposed outside of the back wall, where the rotatable barrel is rotatable with the handle to a first orientation in which the opening faces upward to receive objects from the upper chamber into the barrel chamber, and where the rotatable barrel is rotatable with the handle to a second orientation in which the opening of the barrel chamber faces downward to deposit received objects from the barrel chamber to the lower chamber.

Another general aspect includes an apparatus for dispensing objects. The apparatus also includes a frame having a plurality of walls to enclose an upper chamber and a lower chamber, the frame forming an aperture between the upper chamber and the lower chamber. The apparatus also includes a trough that may be formed by continuously folding an elongated sheet of material integrated with a plurality of front tabs extending outward from one edge of the elongated sheet and integrated with a plurality of rear tabs extending outward from an opposing edge of the elongated sheet. The apparatus also includes a first disk having a plurality of slots that receive the front tabs, and a second disk having a plurality of slots that receive the rear tabs, the first and second disk forming with the trough a rotatable barrel with a barrel chamber and an opening. The apparatus also includes a handle connected to the first disk to enable manual rotation of the barrel. The apparatus also includes the barrel disposed in the aperture with the first disk disposed outside of the one of the walls and the second disk disposed outside another of the walls, where the rotatable barrel is operative to orient with the opening facing upward to receive objects from the upper chamber into the barrel chamber such that when the handle is rotated the rotatable barrel turns to orient the opening downward and deposit objects in the barrel chamber into the lower chamber.

One general aspect includes a method for dispensing objects. The method also includes forming with a plurality of walls of a frame an upper chamber and a lower chamber, and an aperture between the upper chamber and the lower chamber. The method may also include creating a folded sheet by continuously folding an elongated sheet of material integrated with a plurality of front tabs extending outward from one edge of the elongated sheet and integrated with a plurality of rear tabs extending outward from an opposing edge of the elongated sheet. The method also includes forming a rotatable barrel with a barrel chamber and an opening by receiving the front tabs of the folded sheet with a plurality of slots of the first disk and receiving the rear tabs of the folded sheet with a plurality of slots of a second disk. The method also includes connecting a handle to the first disk to enable manual rotation of the rotatable barrel. The method also includes disposing the rotatable barrel in the aperture. The method also includes depositing objects into the upper chamber. The method also includes rotating the connected handle to orient the opening of the rotatable barrel upward to receive objects from the upper chamber into the barrel chamber. The method also includes rotating the connected handle to orient opening of the rotatable barrel downward to deposit objects in the barrel chamber into the lower chamber.

BRIEF DESCRIPTION OF THE DRAWINGS

The detailed description is described with reference to the accompanying figures. In the figures, the left-most digit(s) of a reference number identifies the figure in which the reference number first appears. The use of the same reference number in different figures indicates similar or identical items.

DETAILED DESCRIPTION

Figure 1:
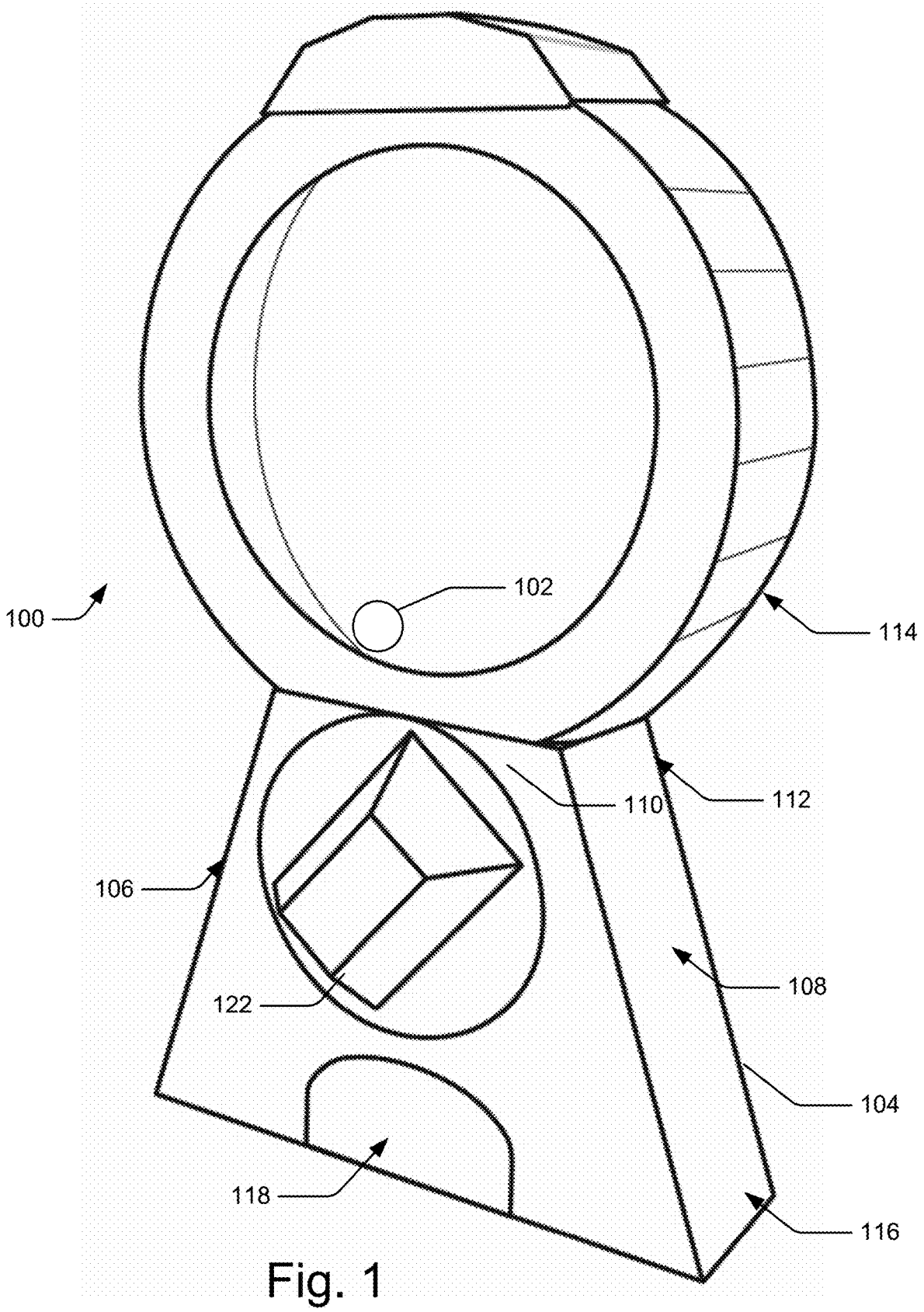
FIG. 1 is a perspective view of a device for dispensing small objects.

Referring to FIG. 1 there is shown a device 100 for dispensing small objects 102. The device includes a frame 104 having a left-side wall 106, a right-side wall 108, a front wall 110 and a back wall 112. The frame 104 encloses an upper chamber 114 and a lower chamber 116 and forms a circular aperture 118 on the front wall 110 and the back wall 112 between the upper chamber 114 and the lower chamber 116 (See also FIG. 13 herein). An aperture 118 is formed with front wall 110 adjacent the lower chamber 116.

In one implementation, writing, illustrations, photograph, or other markings may be imprinted or easily written using an ordinary household writing utensil on the outside back wall 112 or other surfaces of the device 100. These markings enable device 100 to provide a greeting, artwork, illustrations, drawings, photographs, or provide other sayings such as "Congratulations" or "Happy Birthday". Such markings may be applied before or after assembly of the device.

Figure 2B:
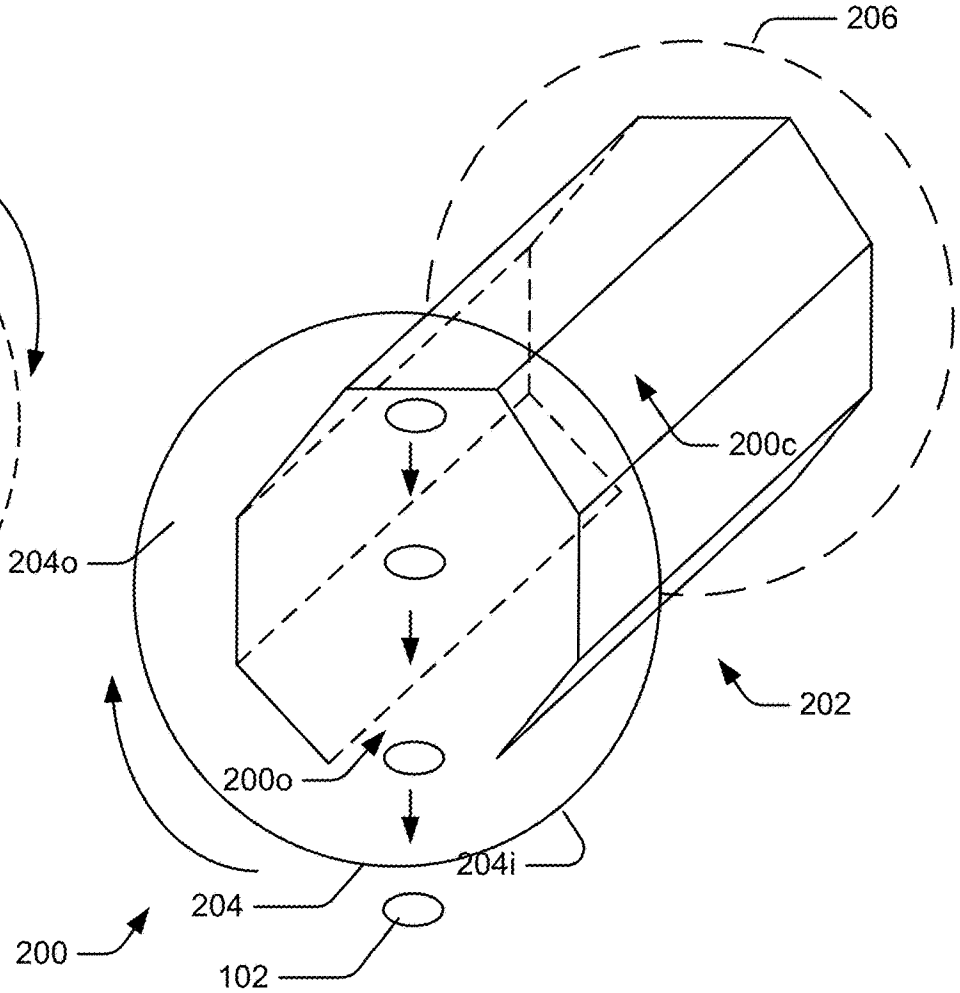
FIG. 2B is perspective view of a downward oriented barrel in the device of FIG. 1 displaying the movement objects from the barrel to a lower chamber of the dispensing device.
Figure 2A:
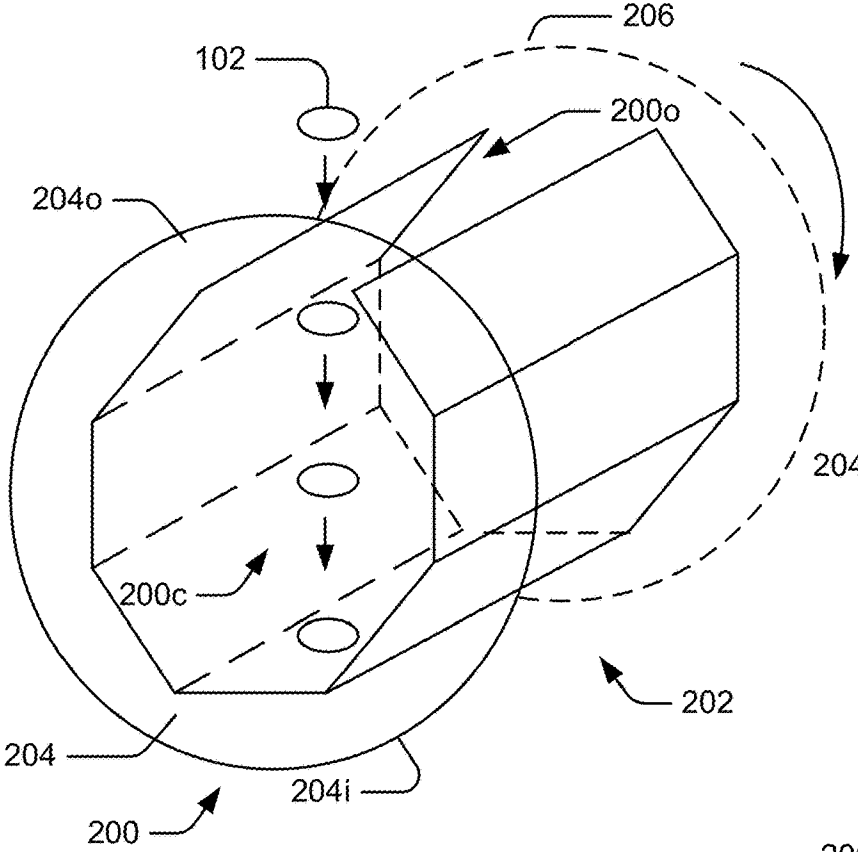
FIG. 2A is perspective view of an upright oriented barrel in the device of FIG. 1 displaying the movement of objects from an upper chamber of the dispensing device into the barrel.
Figure 3:
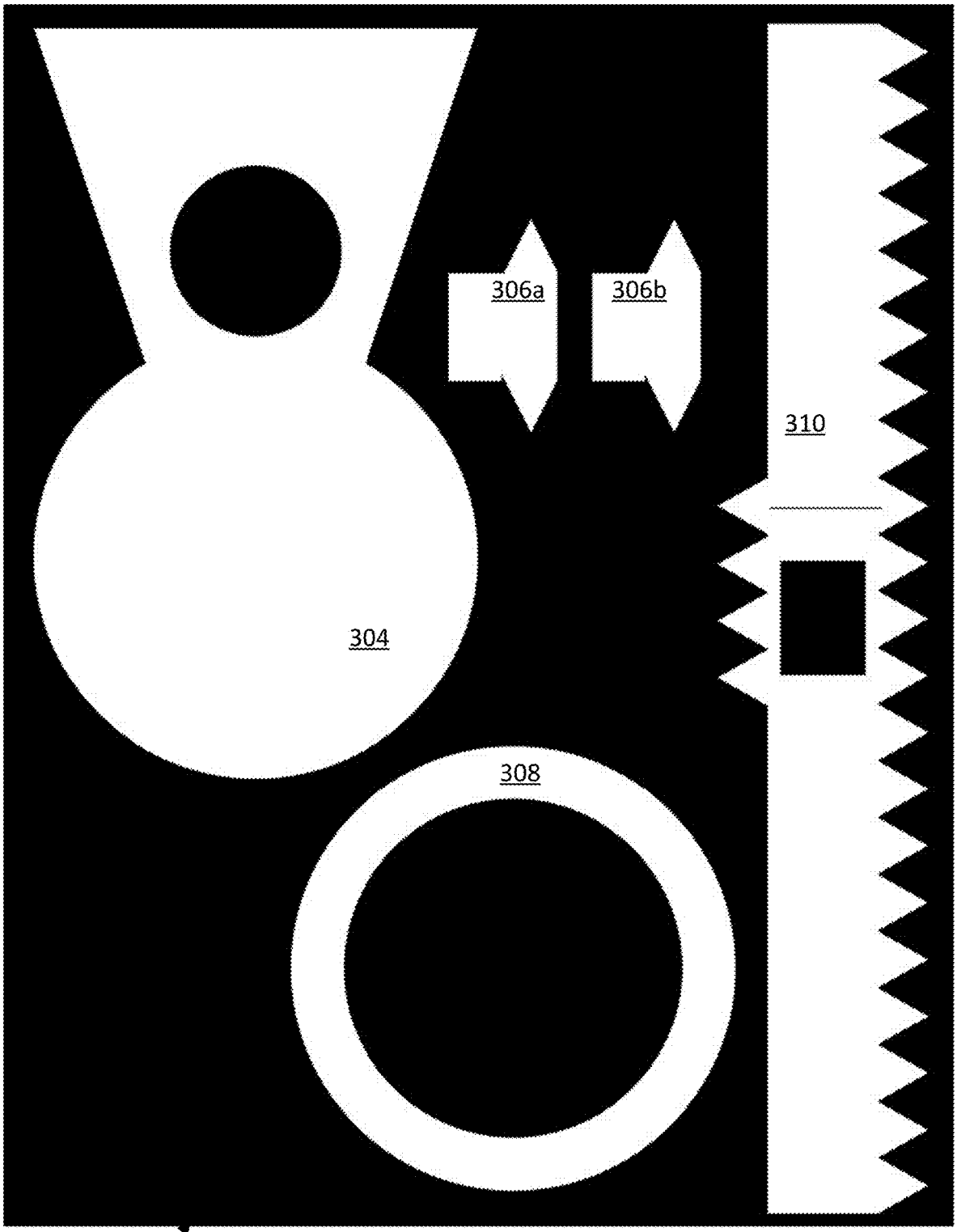
FIGS. 3-6 are top views of patterns imprinted on material used to construct the dispensing device.
Figure 5:
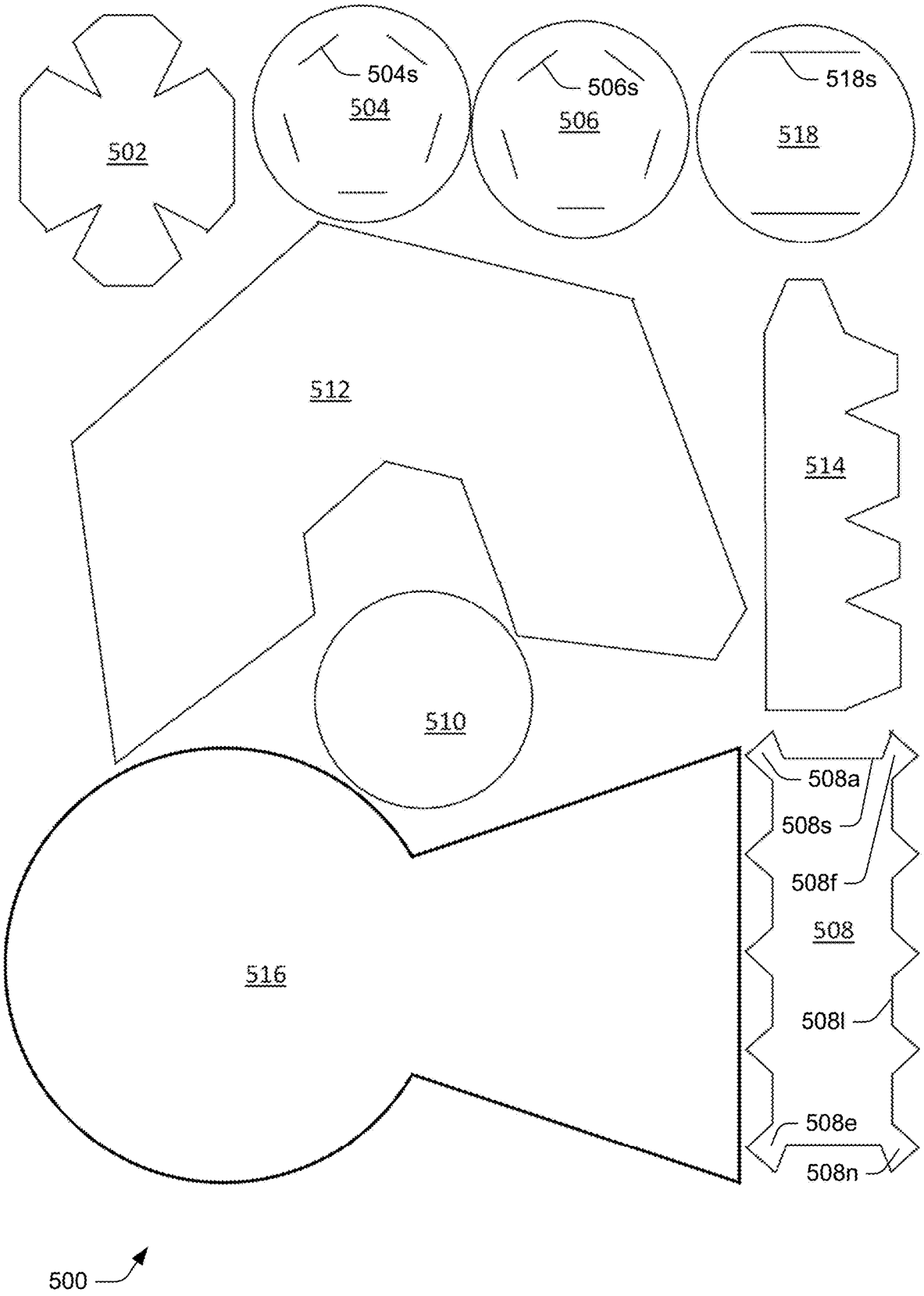

Referring to FIGS. 2A-2B, a rotatable barrel 200 is shown having a trough 202 connected to circular disks 204 and 206. Trough 202 is formed by folding a rectangular sheet 508 of material 500 (FIG. 5). Trough 202 in FIGS. 2A-2B is shown folded six times for illustrative purposes and in actuality may have more or less folds. The rectangular sheet 508 (also referred to herein as barrel pattern 508) of material 500 has long edges 508*l* and short edges 508*s*. The rectangular sheet 508 integrally connected to tabs 508*a-n* extending outward from the rectangular sheet 508 along the long edges 508*l*. The number of tabs 508*a-n* may in another implementation be more or less than the number of tabs shown and may be connected along each of the opposing long edges 508*l*. The exemplary embodiment has five tabs 508*a-e* on one of edges 508*l* and five tabs 508*f-n* on the other of edge 508*l*.

Circular disks 204 and 206 (which may or may not be circular shaped) may each have an outside surface 204*o*, 206*o* and an inside surface 204*i* and 206*i*. The circular disk 204 has slots (504*s* in FIG. 5) that receive tabs 508*a*-508*e* on its inside surface along one of the long edges of the formed trough 202. Circular disk 206 has slots 206*s* (506*s* in FIG. 5) that receive the tabs (508*f*-508*n*) on its inside surface 206*i* along the other of the long sides of the formed trough 202 to form rotatable barrel 200 with a barrel chamber 200*c* and an opening 200*o*.

Referring to FIGS. 1 and 2, a handle 122 (FIG. 1) is connected to an outside surface of circular disk 204 to rotate the rotatable barrel 200 around a horizontal axis. The rotatable barrel 200 is located in the aperture 1220 (FIG. 12B) with the circular disk inside surface 204*i* located outside of the front wall 110 and circular disk inside surface 206*i* located outside of the back wall 112. Handle 122 may be attached to circular disk outside surface 204*o*.

During operation, objects 102 are inserted into device 100 through a hole in the top of frame 104. Objects 102 may be any small object, and preferably are round objects including candy (Skittles®, M&M's®) marbles, etc. During operation, objects 102 will be initially disposed in the upper chamber 114.

Referring to FIG. 2A, the barrel chamber 200*c* may be turned to orient with the opening 200*o* facing upward to receive the objects 102 from the upper chamber 114 into the barrel chamber 200*c*. Referring to FIG. 2B, when the handle 122 is rotated about a horizontal axis the rotatable barrel 200 turns to orient the opening 200*o* downward to deposit objects 102 in the barrel chamber 200*c* into the lower chamber 116.

Figure 6:
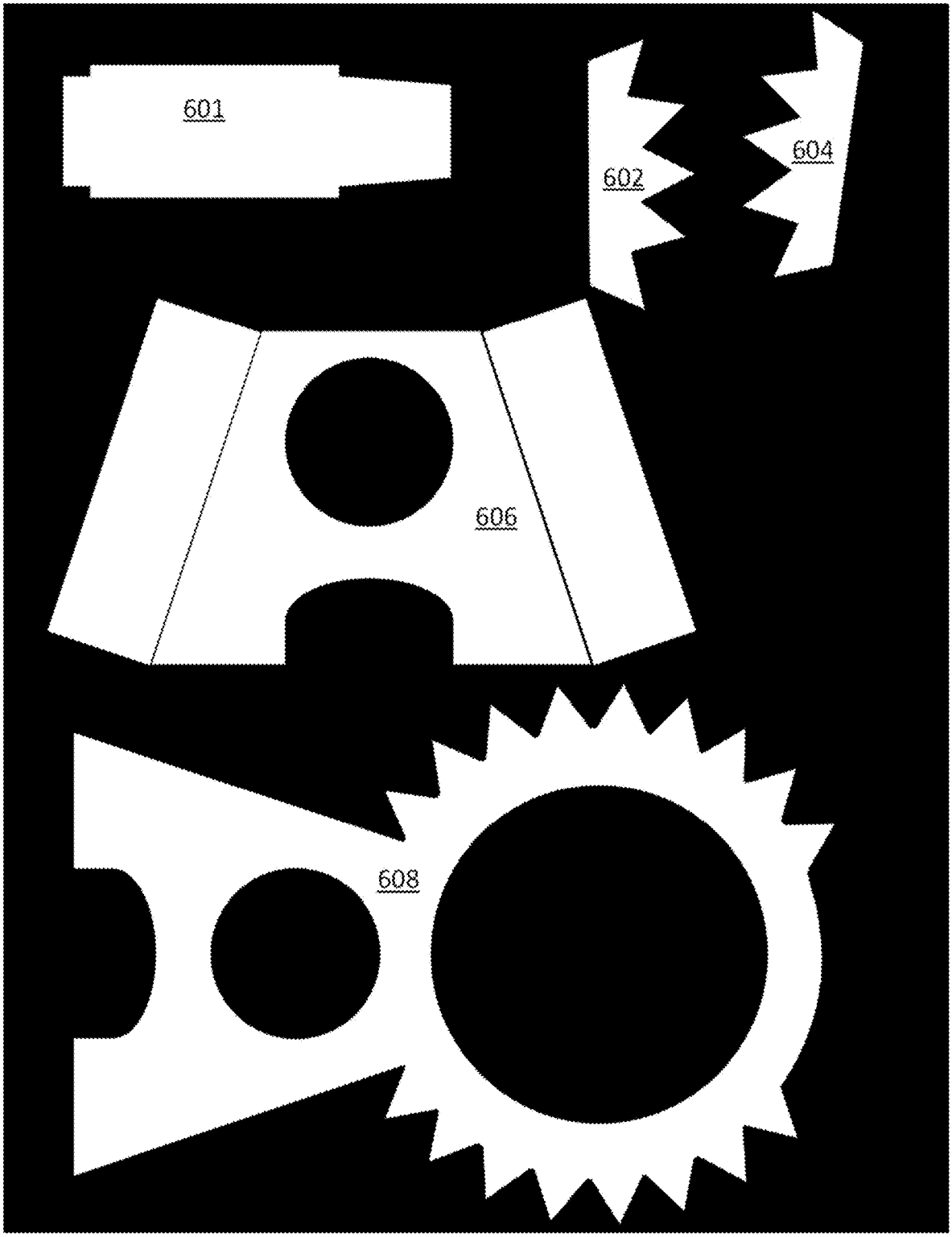

Referring to FIGS. 3-6 there are shown patterns imprinted on material 300, 400, 500 and 600 that are cut out along pattern edges to construct the dispensing device 100. In one implementation, material 300, 400, 500 and 600 is heavy grade construction paper or cardstock. Patterns 302 in FIG. 3, patterns 402 in FIG. 4, patterns 516 in FIG. 5, and patterns 608 in FIG. 6 are used to construct frame 100. Patterns 504-510 are used to construct rotatable barrel 200. Patterns 512 and 514 are used to construct a funnel for filling device 100 with objects 102. Patterns 502 and 518 are used to construct handle 122.

Referring to FIGS. 7A-7C, and 8B-D there is shown frame 900. Frame 900 is constructed by folding pattern 310, and attaching patterns 608, and 404 using an adhesive to form the side walls 106-108 and front wall 110 (FIG. 1).

Figure 7A:
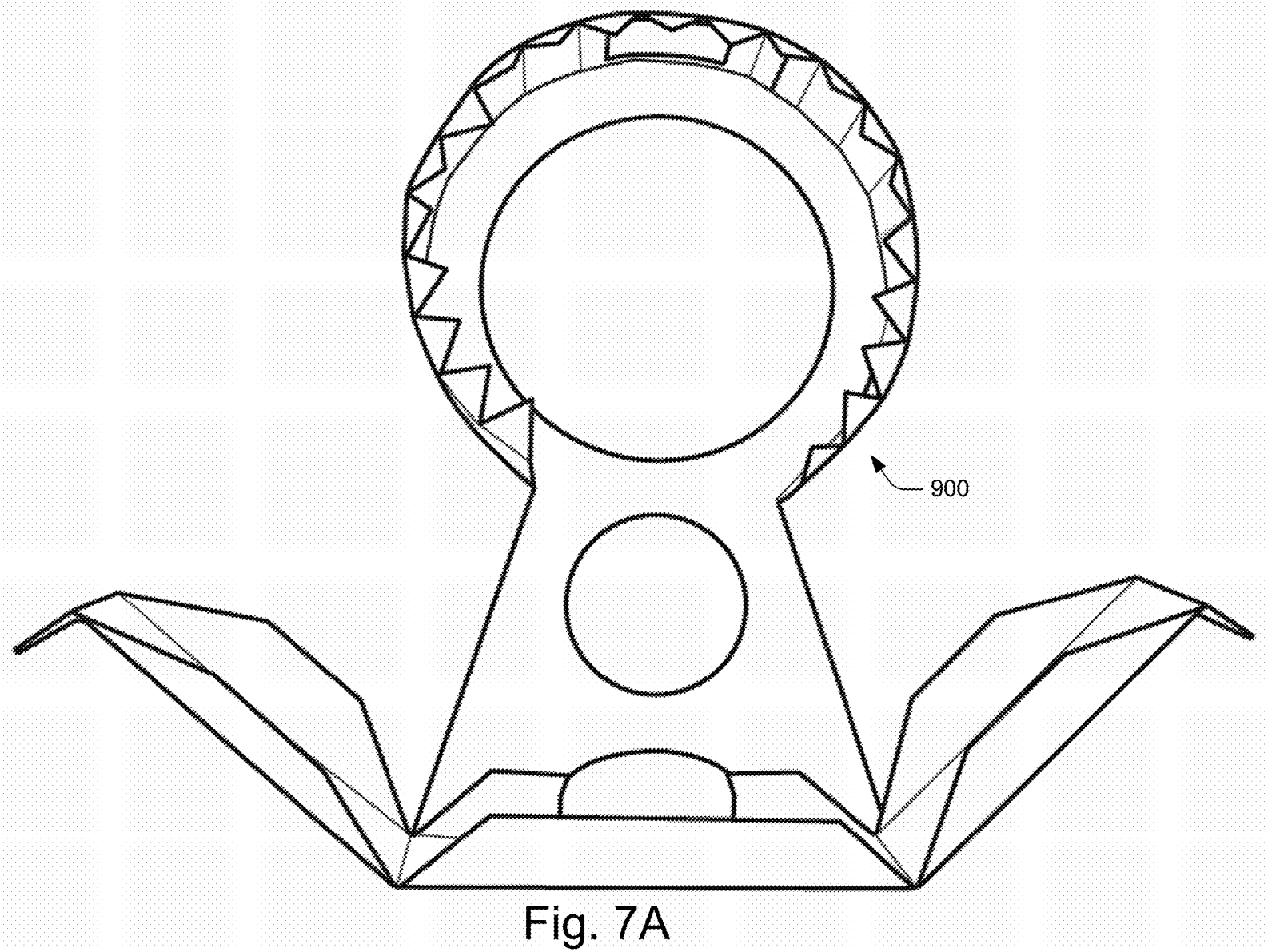
FIGS. 7A-7C are perspective view of the construction of a frame of the dispensing device.
Figure 7B:
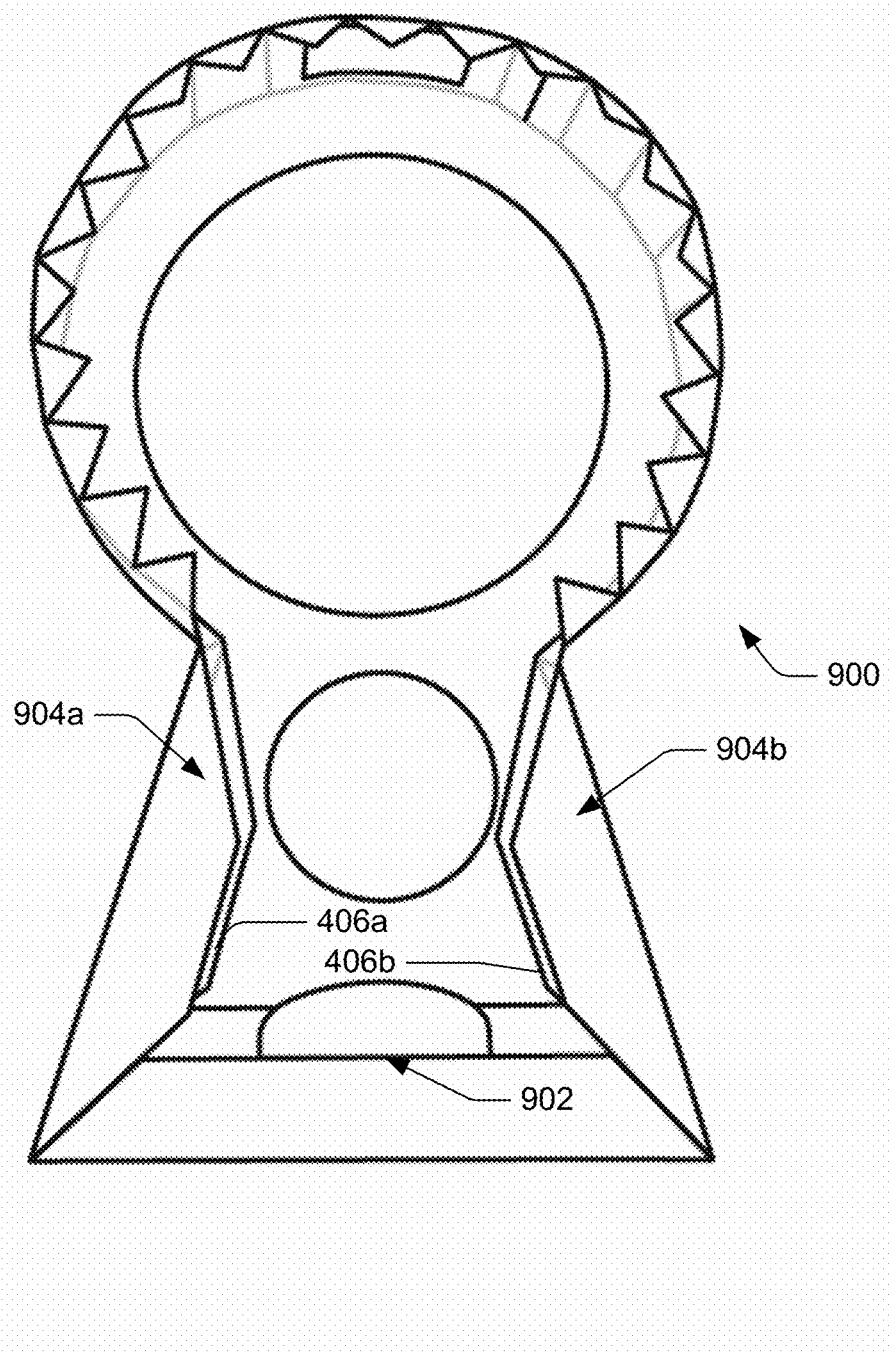
Figure 7C:
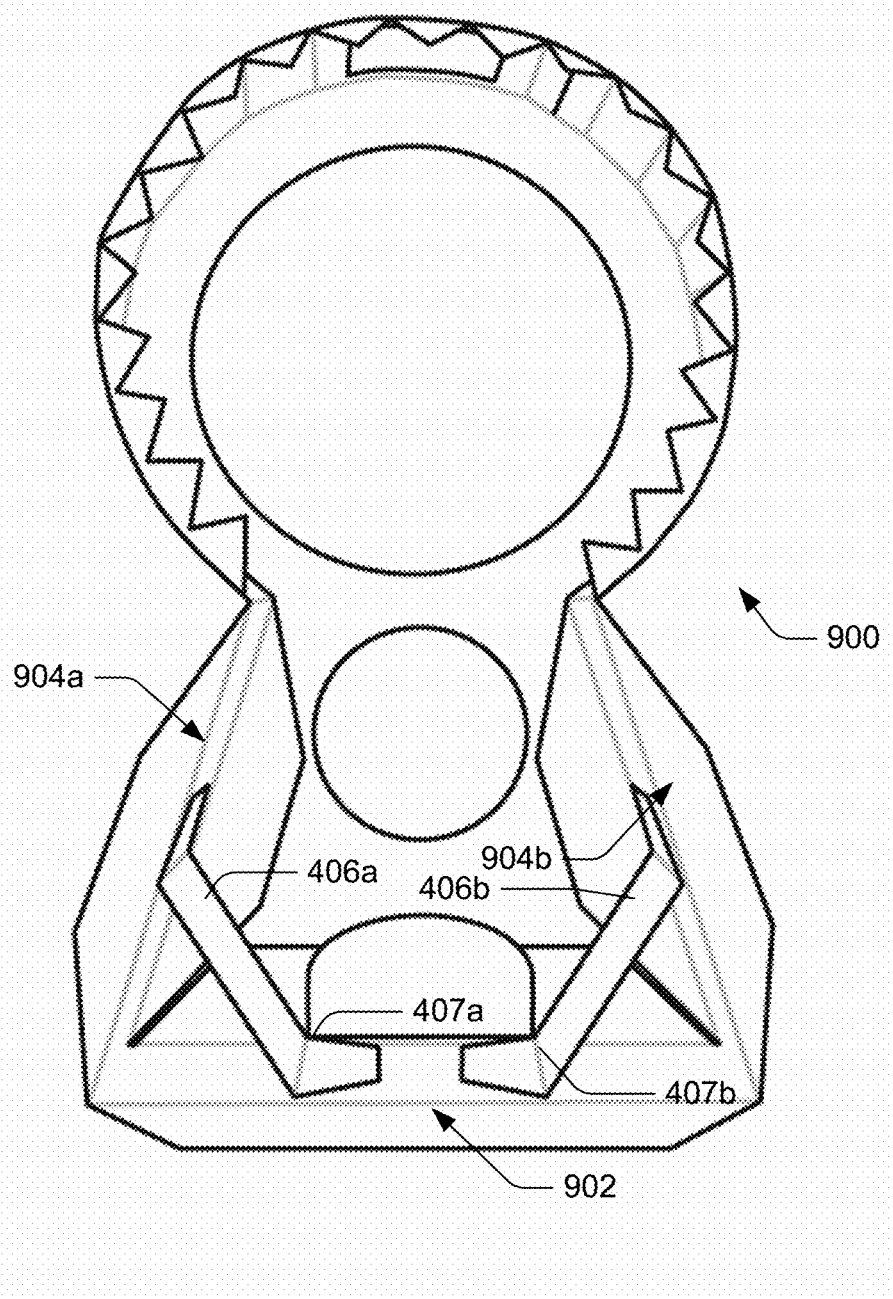

Referring to FIG. 7C, frame 900 is shown with patterns 406*a* and 406*b* (See FIG. 4) (also referred to as lower skirts) folded along line 407*a* and 407*b* and attached to a floor 902 and walls 904*a* and 904*b* of frame 900 within lower chamber 116. Lower skirts 406*a* and 406*b* when attached assist in guiding objects deposited from rotatable barrel 200 into lower chamber 116.

Figure 8A:
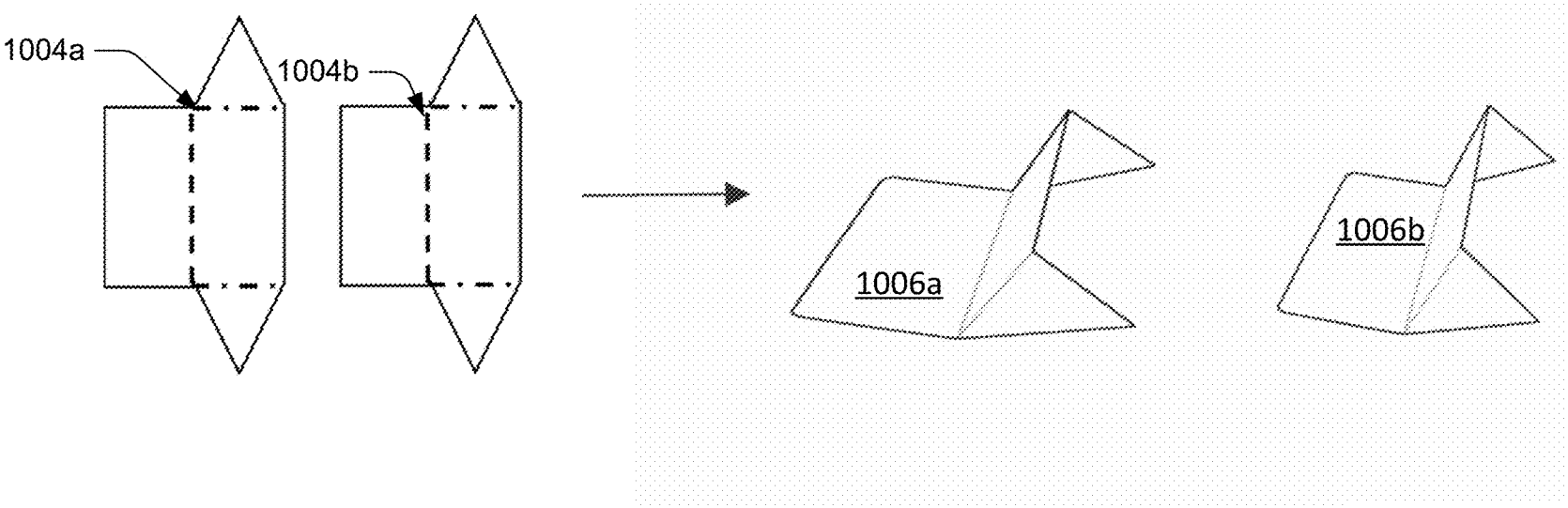
FIGS. 8A-8D are perspective view of items used in the construction of the dispensing device, with FIG. 8C being a partial detailed view of FIG. 8B.
Figures 8B, 8C, 8D:
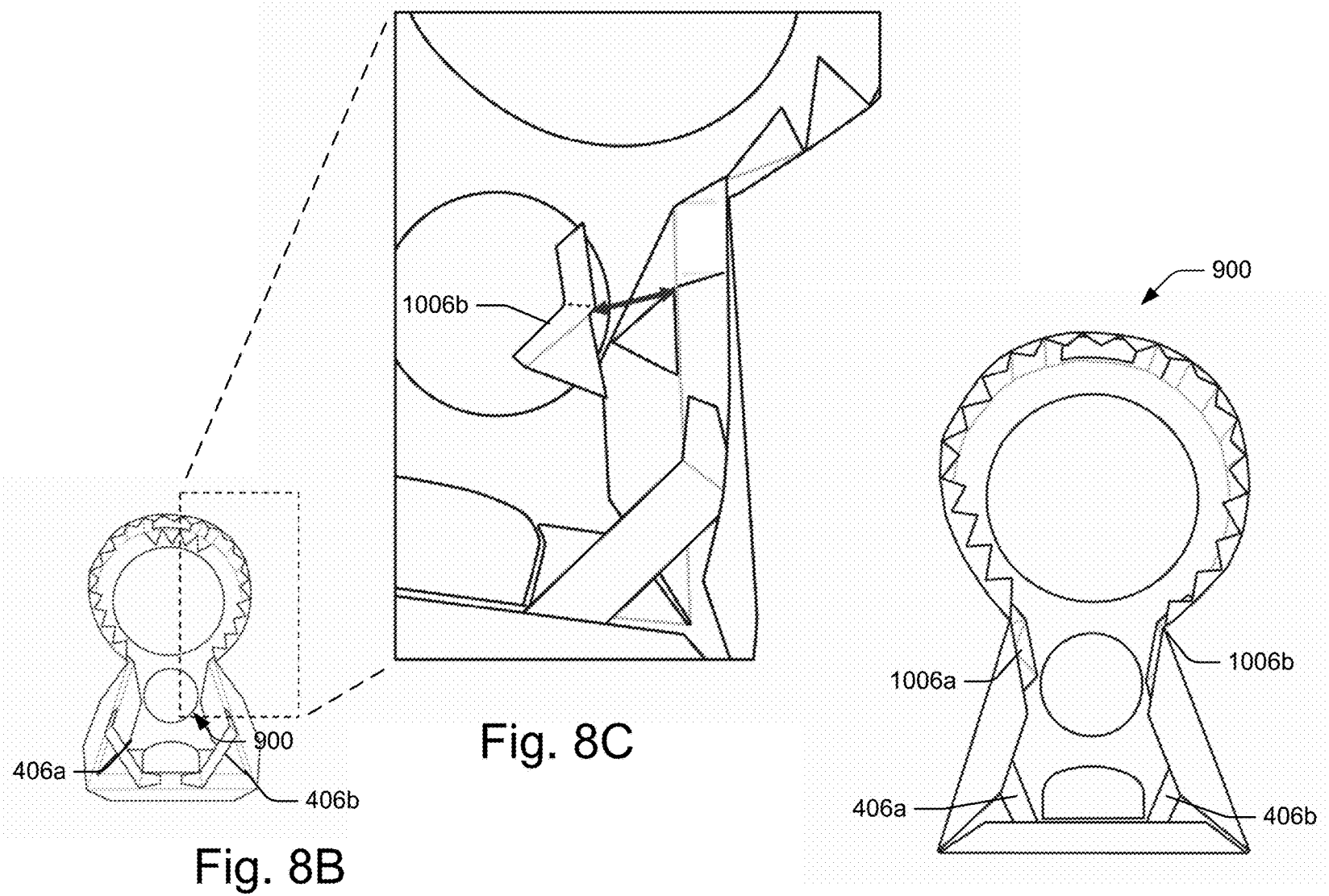

Referring to FIG. 8B-8D, frame 900 is shown with patterns 1006*a* and 1006*b* (306A and 306B of FIG. 3) (also referred to herein as upper skirts) folded (See FIG. 8A) by scoring upper skirts along lines 1004*a* and 1004*b* and attaching with adhesive the skirts to walls 904A and 904B of frame 900 adjacent the upper chamber of the device 100. Upper skirts 1006*a* and 1006*b* assist in guiding objects in upper chamber into an opening 200*o* in rotatable barrel 200.

Figure 9B:
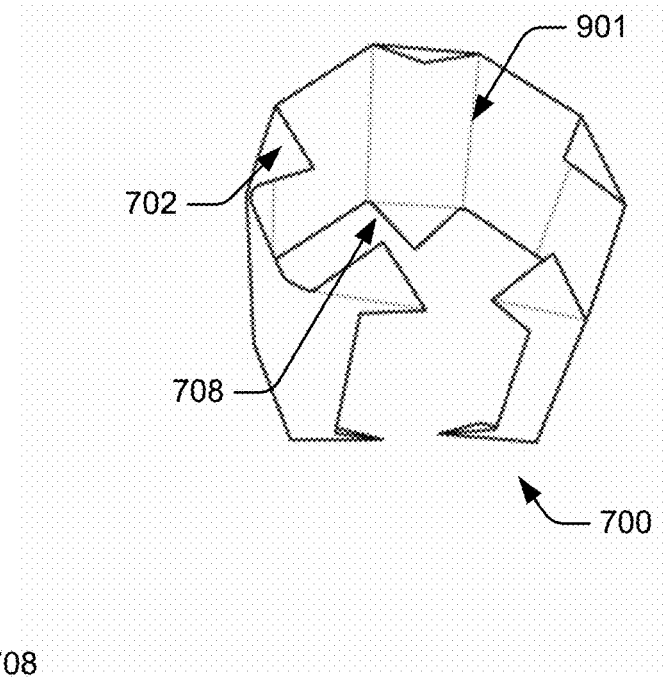
FIGS. 9A-9B are perspective views of the barrel pattern of FIG. 5 folded to form a rotatable barrel.
Figure 9A:
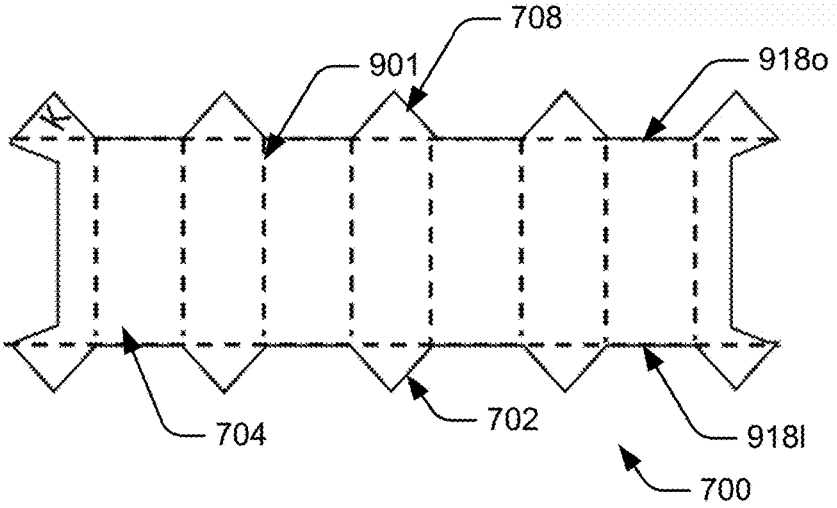

Referring to FIGS. 9A-9B, the barrel pattern 508 of FIG. 5 is substantially rectangular shaped sheet of material and folded along multiple evenly spaced lines 901 running perpendicular to the long edge 9181 to form a trough 700 (trough 202 of FIG. 2). Tabs 702 (Tabs 508*a*-508*n* of FIG. 5) are integrally connected to the rectangular material on one long edge 918*l* and Tabs 708 are integrally connected to the rectangular material on an opposing long edge 918*o*. Tabs 702 and 708 are folded to extend perpendicular to floor 704 of trough 700.

Figure 10A:
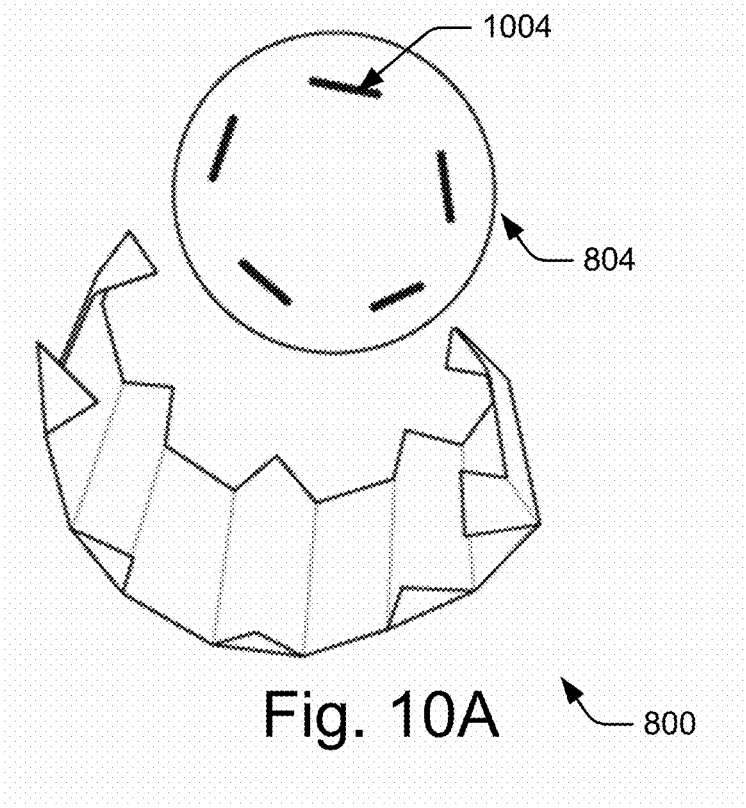
FIGS. 10A-10C are perspective views of the folded barrel of FIGS. 9A-9B with its tabs inserted into slits of a circle pattern.
Figure 10B:
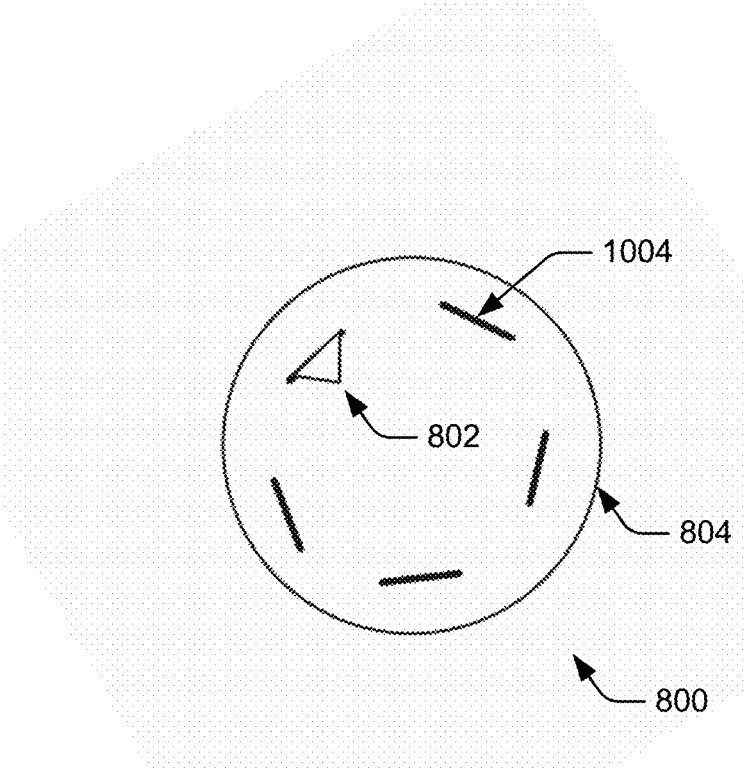
Figure 10C:
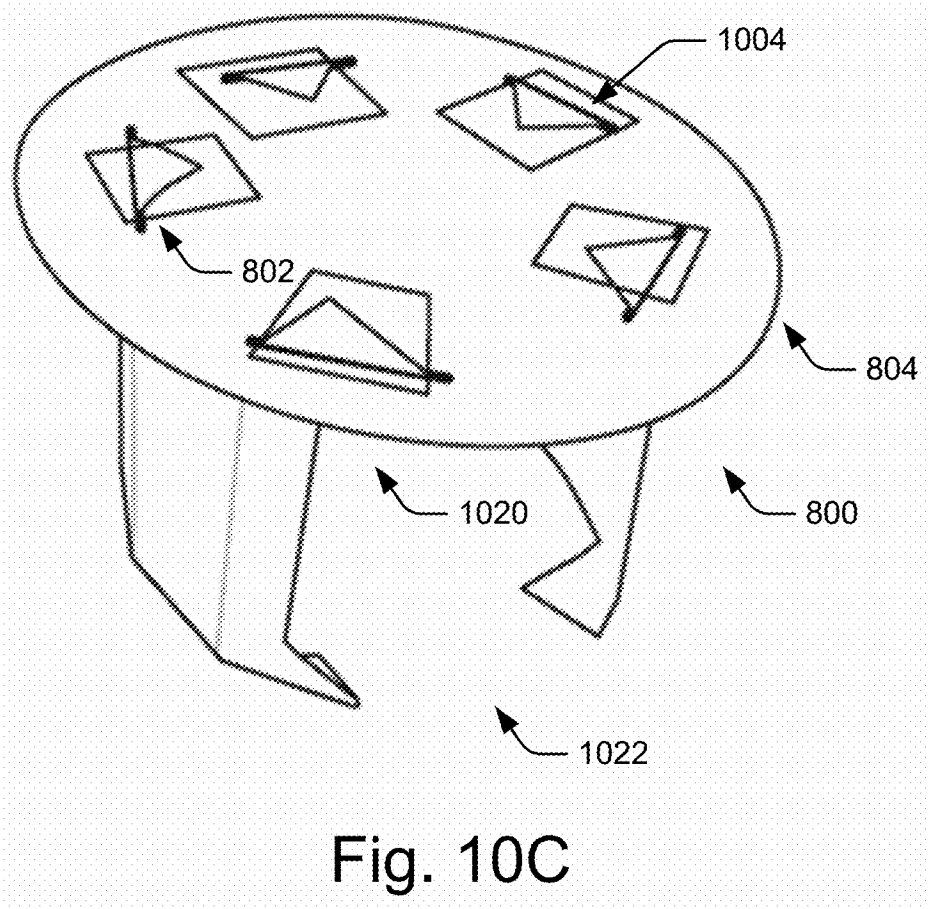

Referring to FIGS. 10A-10C, there is shown rotatable barrel 800. Barrel 800 is constructed by inserting the tabs 802 (tabs 508*a*-*e* of FIG. 5) of trough 700 (FIGS. 9A-9B) into slits 1004 (slits 504*a*-*n* of FIG. 5) of a circle pattern or disk 804 (disk 204 of FIG. 2). Referring to FIG. 10C, the tabs 802 may then be attached to disk 804 with an adhesive. Rotatable barrel 800 is thus formed having a barrel chamber 1020 with an opening 1022.

Figure 11C:
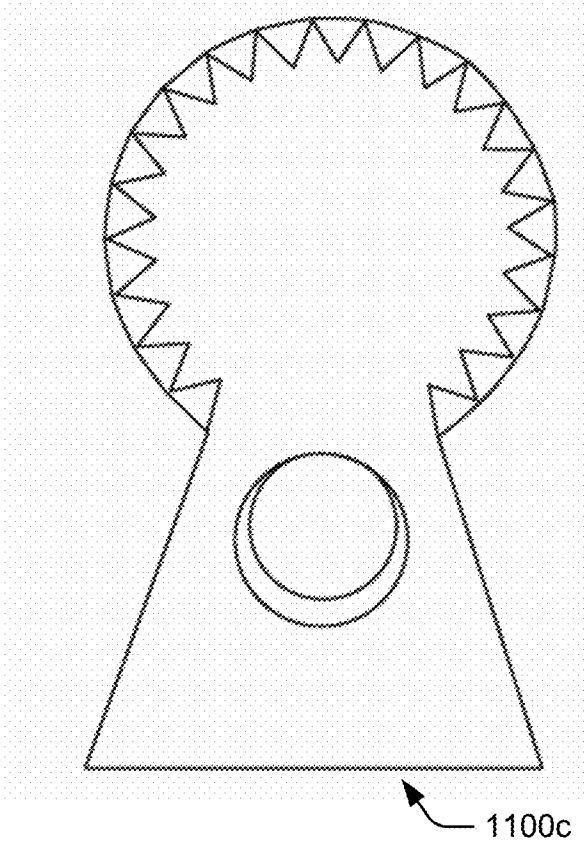
FIGS. 11A-11C are rear perspective views of the construction of a back of the frame of the dispensing device.
Figure 11B:
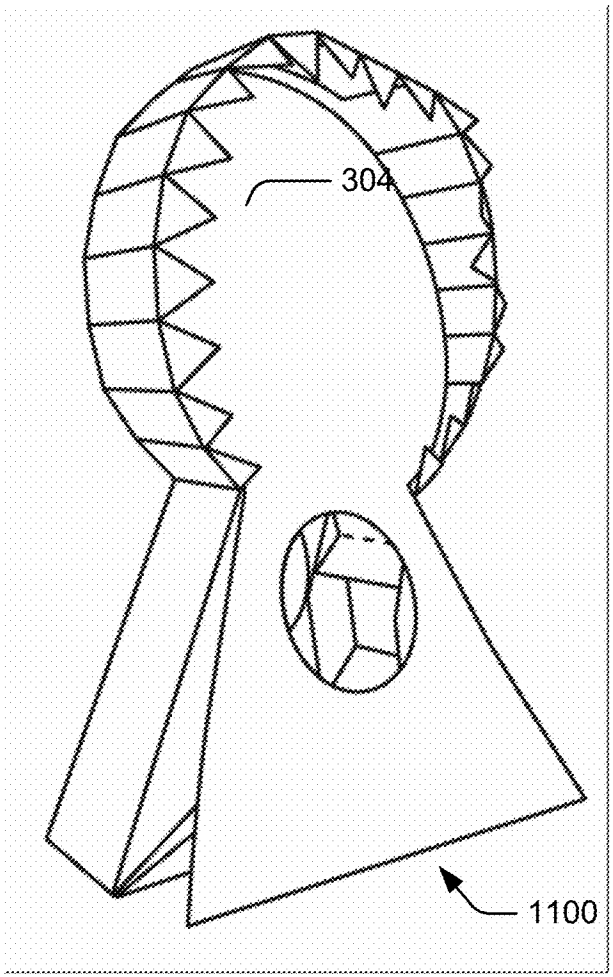
Figure 11A:
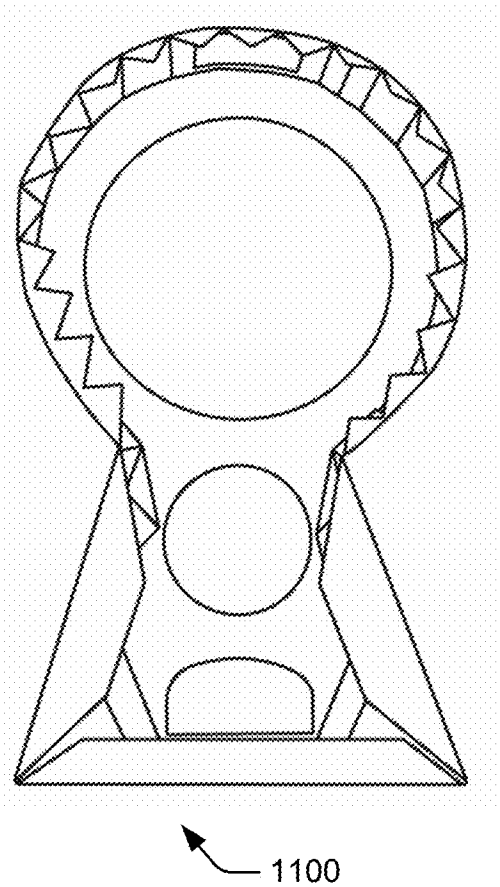

Referring to FIGS. 11A-11C, there is shown a back of the frame 1100 of the dispensing device 100. In dispensing device 100 pattern 304 is attached to frame 1100 using an adhesive to form frame 1100*c*.

Figure 12C:
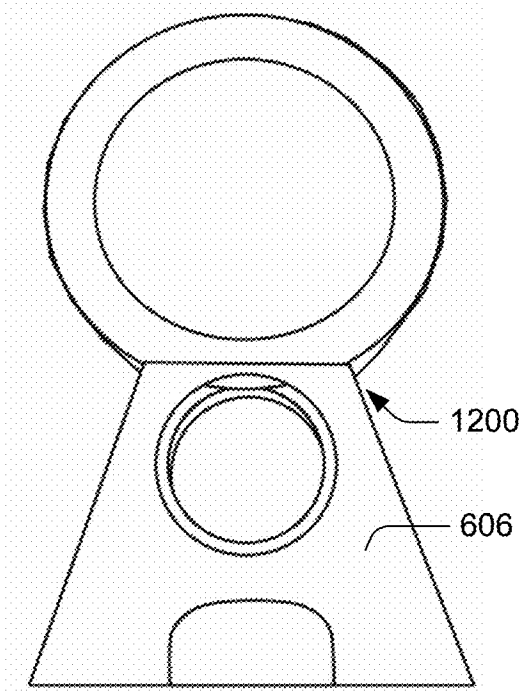
FIGS. 12A-12C are front perspective views of the construction of a front of the frame of the dispensing device.
Figure 12B:
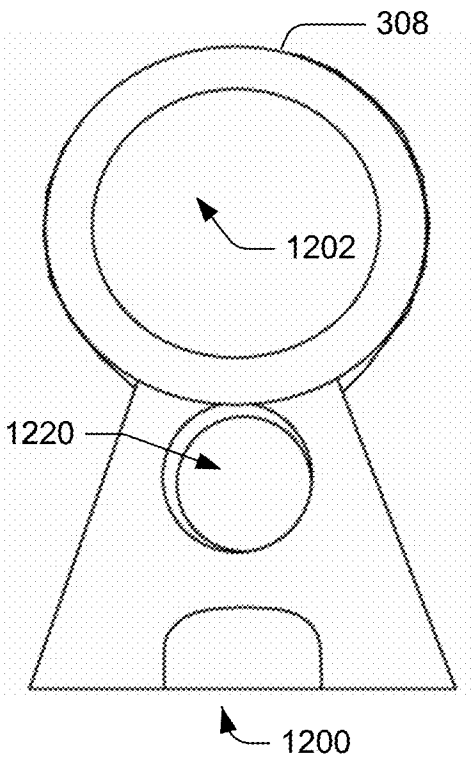
Figure 12A:
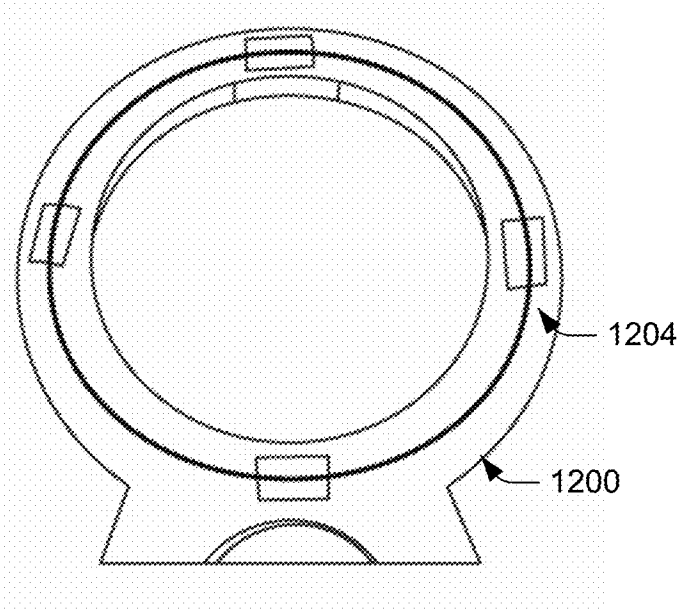

Referring to FIGS. 12A-12C, pattern 308 and pattern 606 are shown attached to the front of the frame 1200 and an aperture 1220 is formed by the frame 1200. Referring to FIG. 12A, a clear plastic window 1204 is attached to the front of frame 1200.

Figure 13B:
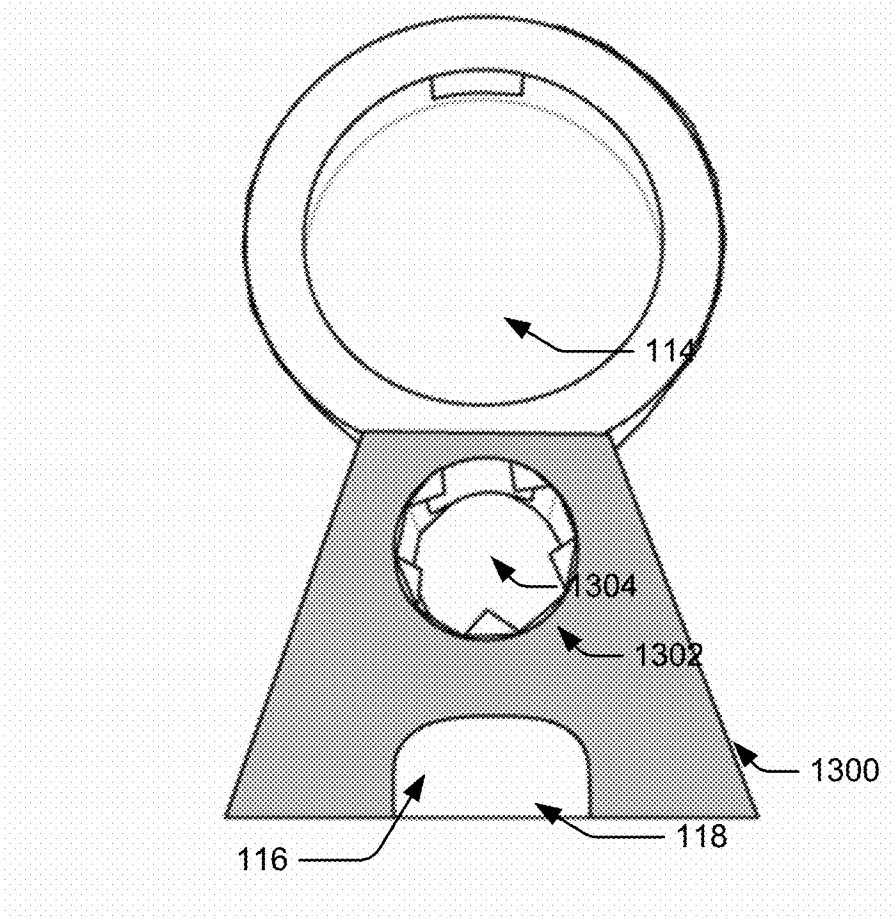
FIG. 13A-B are rear and front perspective views respectively of the construction of the frame of the dispensing device displaying the rotatable barrel insertion.
Figure 13A:
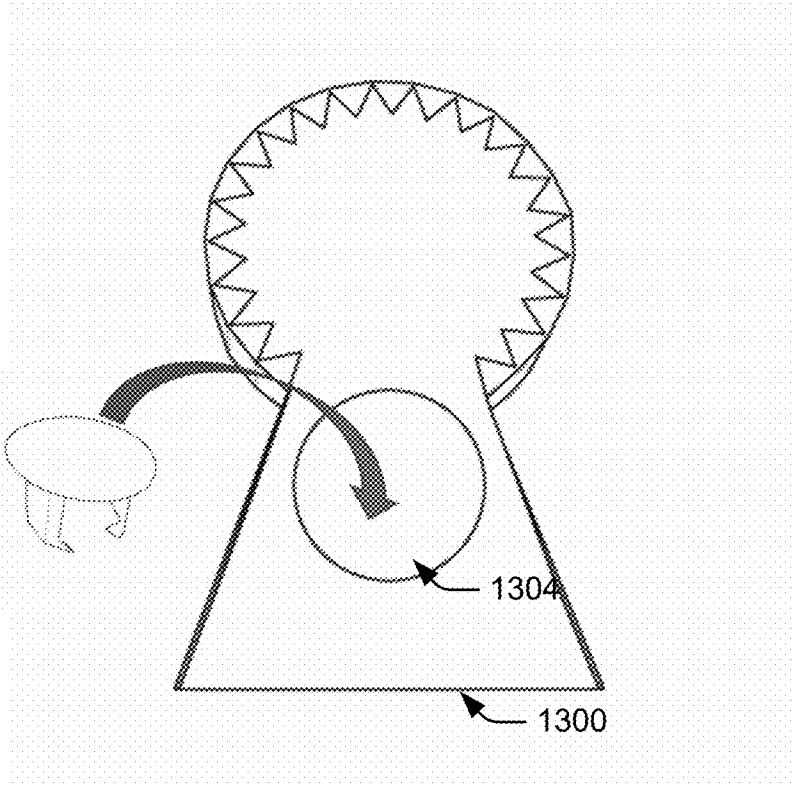

Referring to FIG. 13A-B, there is shown frame 1300 with rotatable barrel 1302 (barrel 800 of FIG. 10C) inserted into the aperture 1304 from a rear of the frame 1300. Frame 1300 includes an upper chamber 114 in which objects are inserted. Frame 1300 also includes a lower aperture 118 to enable escape of objects deposited in the lower chamber 116.

Figure 14:
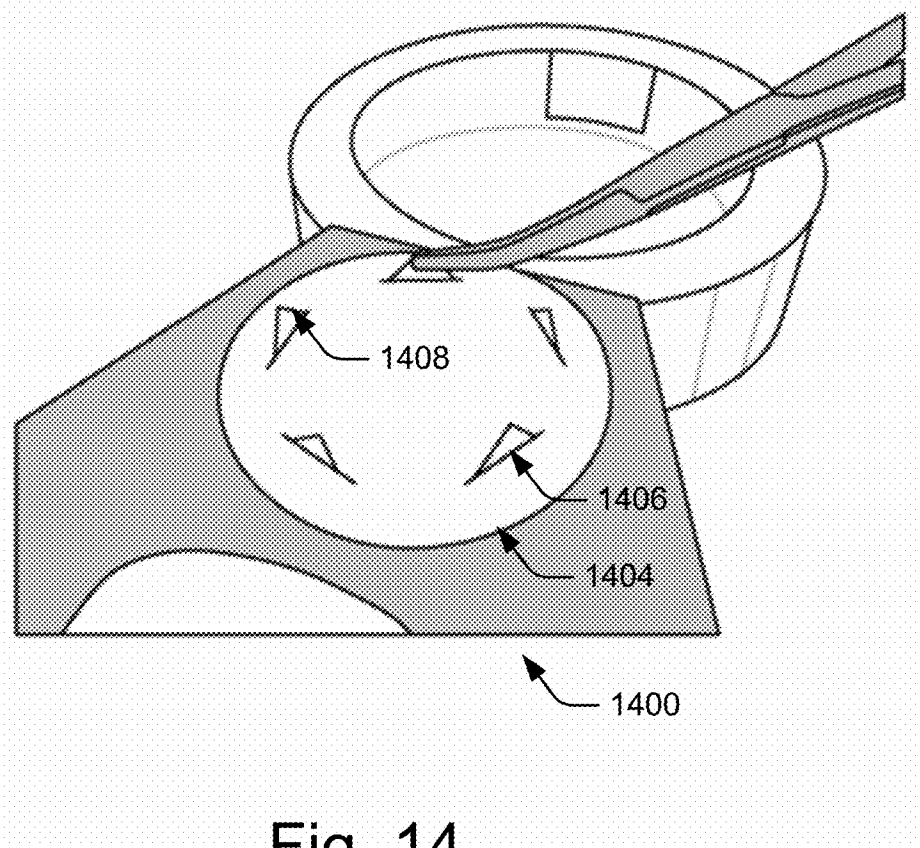
FIG. 14 is a front perspective views of the construction of a front of the frame of the dispensing device with the rotatable barrel inserted.

Referring to FIG. 14, there is shown a front of frame 1400 with the rotatable barrel being formed by attaching cylindrical disk 1404 (disk 206 of FIG. 2) to the folded trough 700 and inserted into aperture 1220 (aperture 1304 of FIG. 13), and tabs 1406 are inserted through slits 1408.

Figure 15:
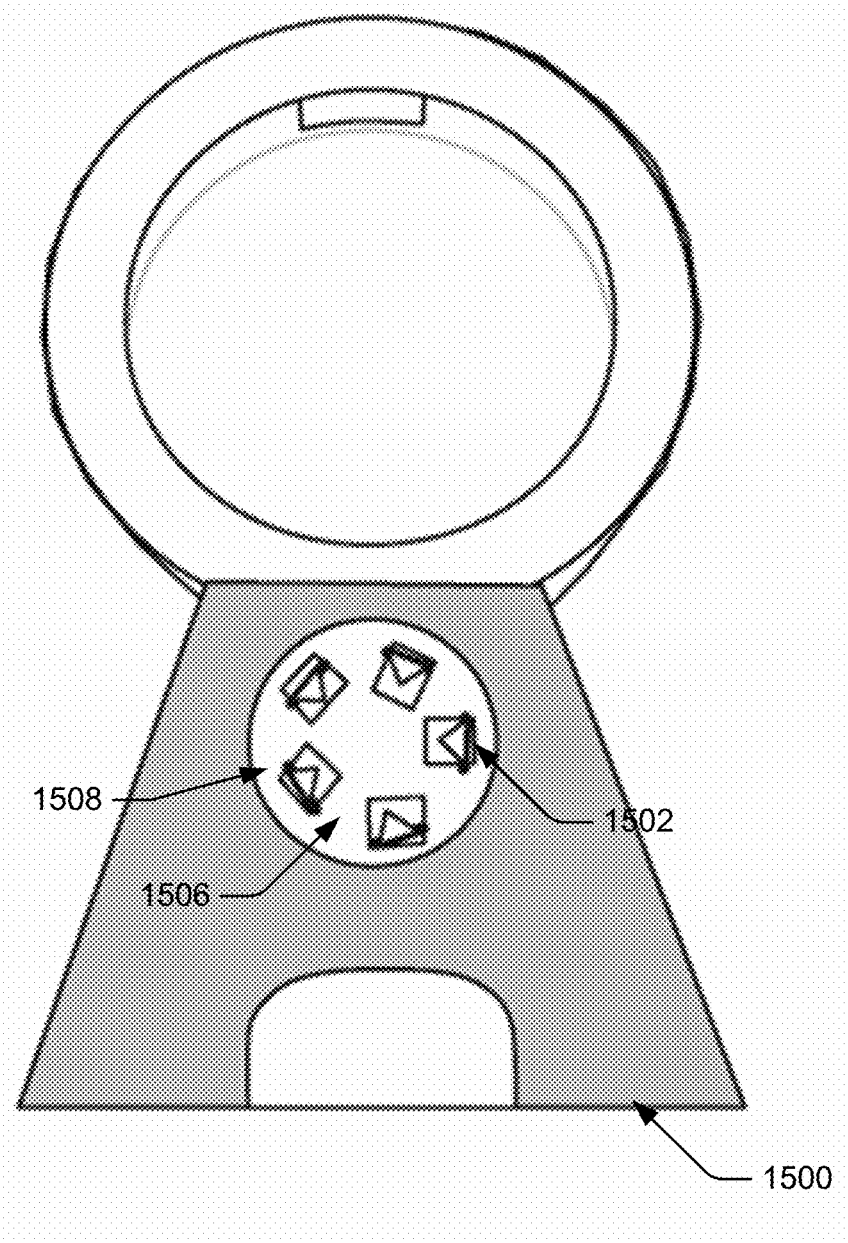
FIG. 15 is a front perspective view of the construction of the front of the frame of the dispensing device with the rotatable barrel inserted with its tabs engaging with a front circular disk.

Referring to FIG. 15, frame 1500 is shown with tabs 1502 of rotatable barrel 800 (FIG. 10) inserted into slits 1504 of front cylindrical disk 1506 (disk 206 of FIG. 2) to form the barrel 1508.

Figure 16:
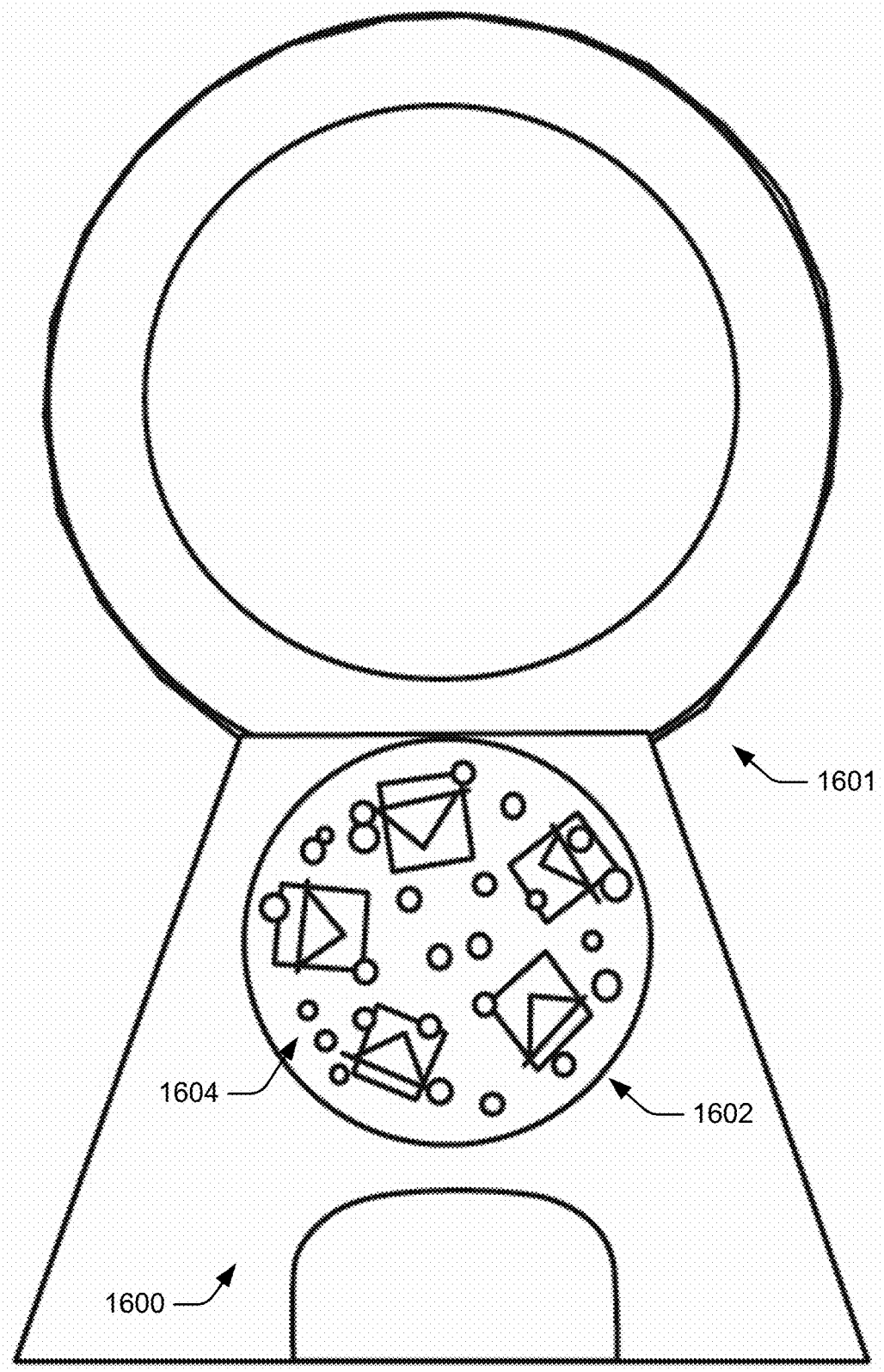
FIG. 16 is a front perspective view of the construction of the front of the frame of the dispensing device with the front circular disk having adhesive applied for engagement with a handle.

Referring to FIG. 16, there is shown a front side of the frame 1600 of the dispensing device 1601 with front circular disk 1602 having adhesive 1604 applied for engagement with a handle 122.

Figure 17B:
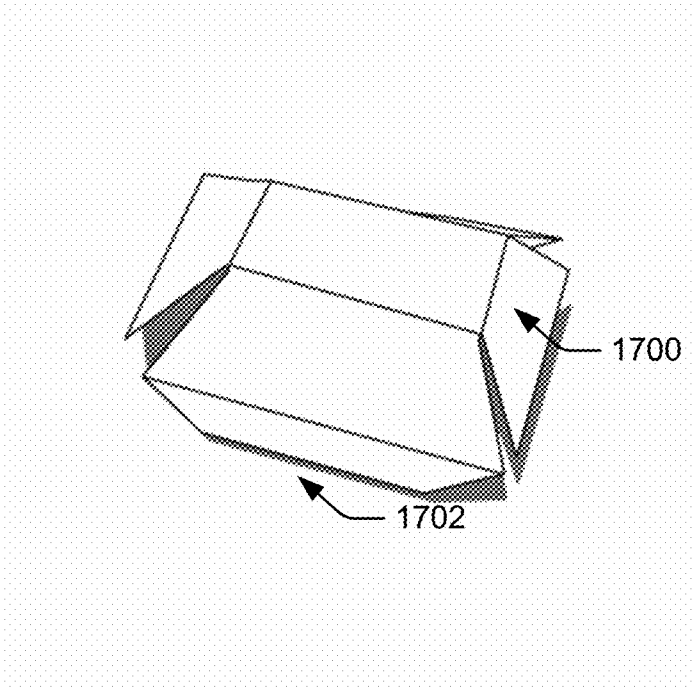
FIGS. 17-18 is a front perspective view of the construction of the front of the frame of the dispensing device with the front circular disk engaged with a handle.
Figure 17A:
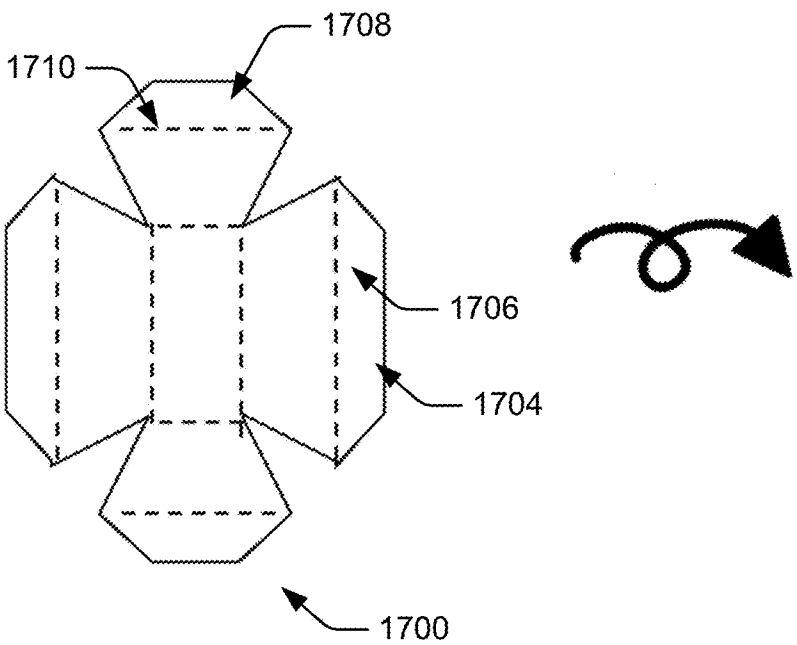

Referring to FIGS. 17A-B, there is shown handle 1700 (handle 122 of FIG. 1) constructed from pattern 502 and 518. Tabs 1704 of pattern 502 are folded along score lines 1706 and attached with adhesive to handle cylindrical disk 1702 (pattern 518 of FIG. 5). Tabs 1708 of pattern 502 are folded along score lines 1710 and inserted into slits 518*s* in handle cylindrical disk 1702.

Figure 18:
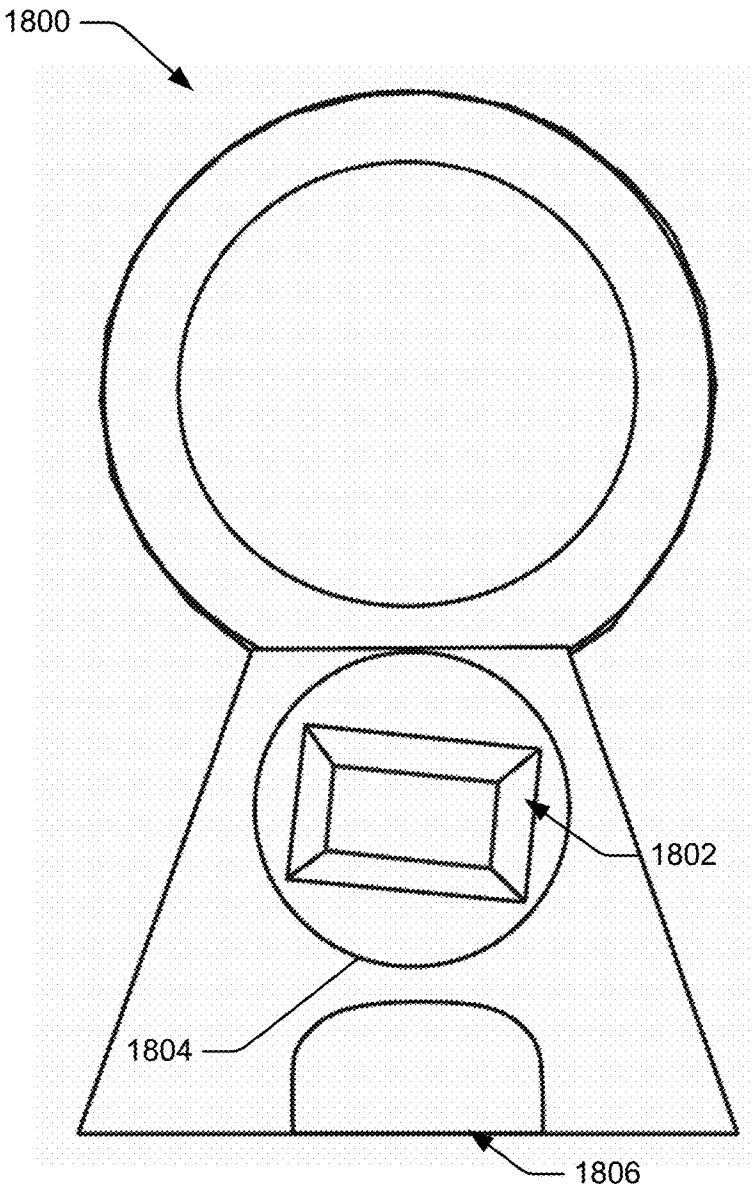

Referring to FIG. 18, there is shown the front of the frame 1800 of the dispensing device with the handle 1802 attached to the front circular disk 1804, and a front opening 1806 through which small objects (not shown) can be retrieved.

Figure 4:
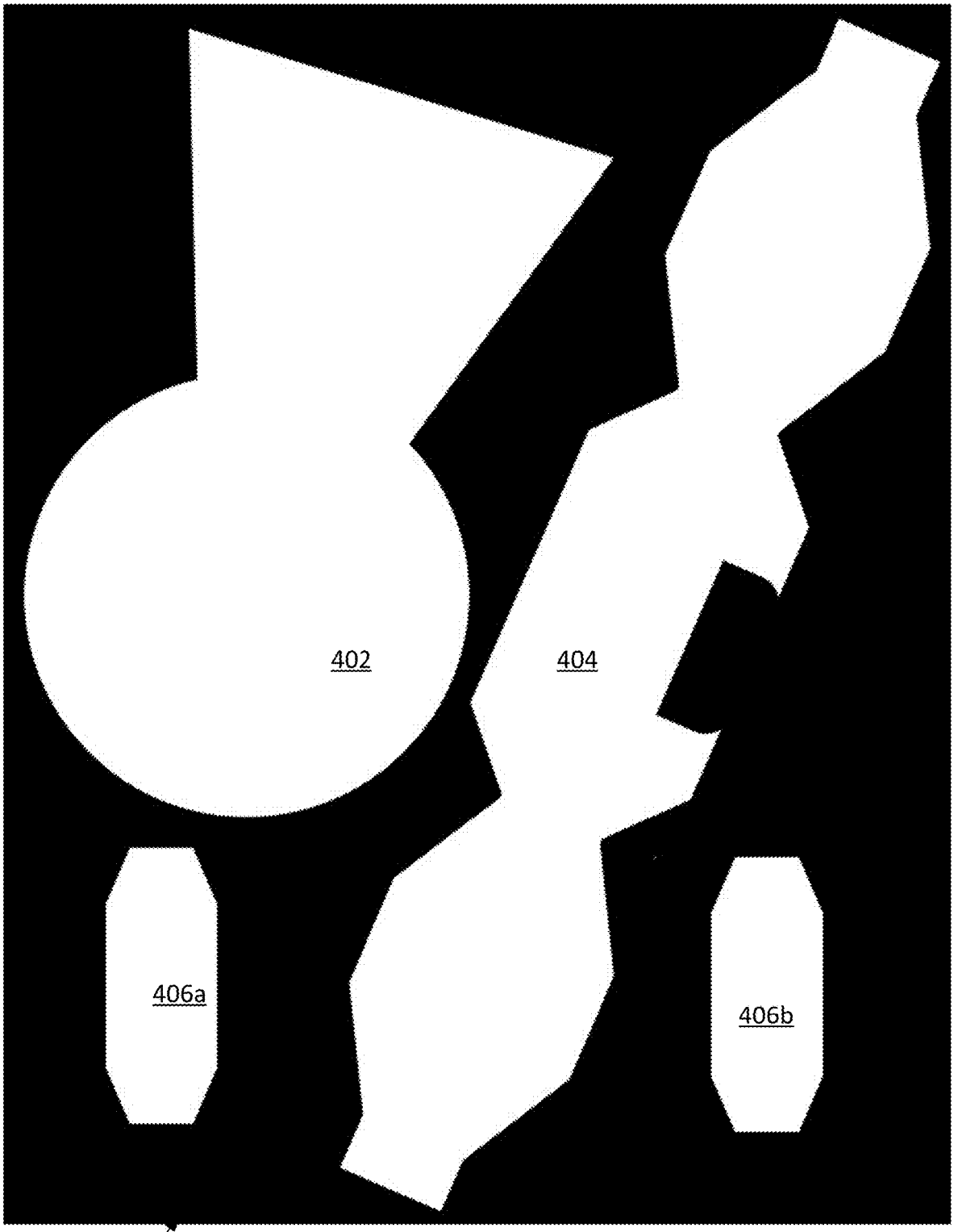
Figure 19:
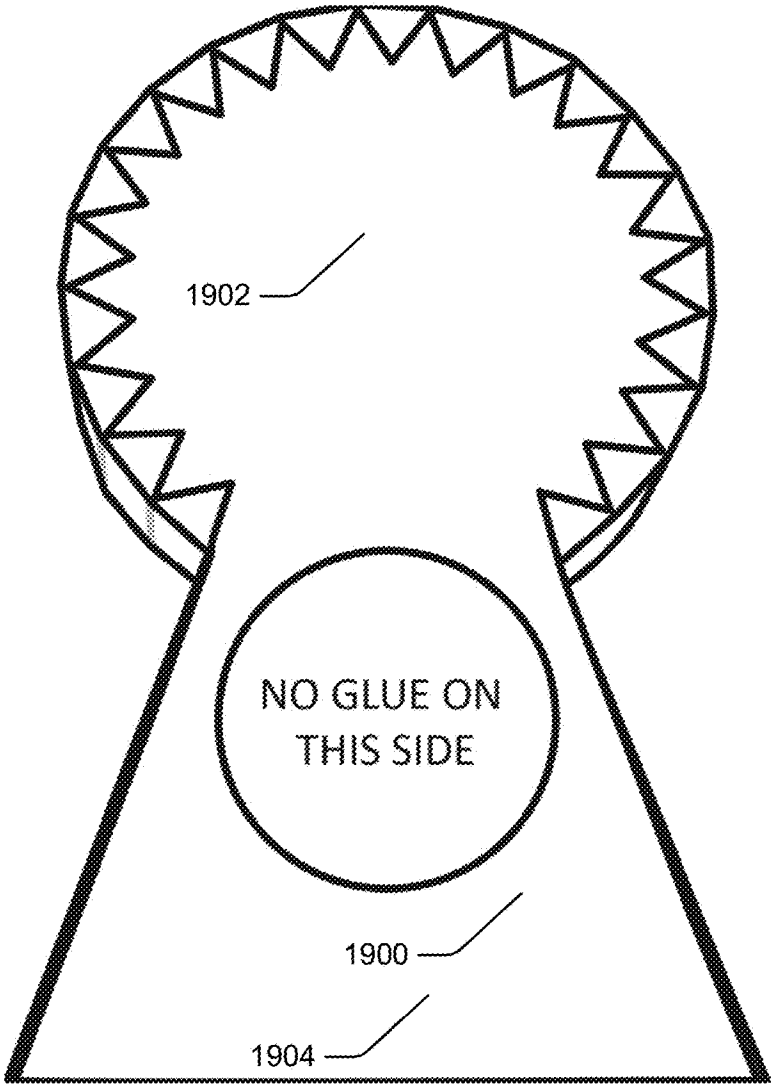
FIG. 19 is a rear perspective view of the construction of the rear of the frame of the dispensing device with the frame rear surface having adhesive applied for engagement with a backing.

Referring to FIG. 19, there is shown the rear of the frame 1902 of the dispensing device 1900 with the frame 1900 with a rear surface 1902 having adhesive 1904 applied for engagement with a backing 2006 (FIG. 20) (pattern 402 of FIG. 4).

Figure 20:
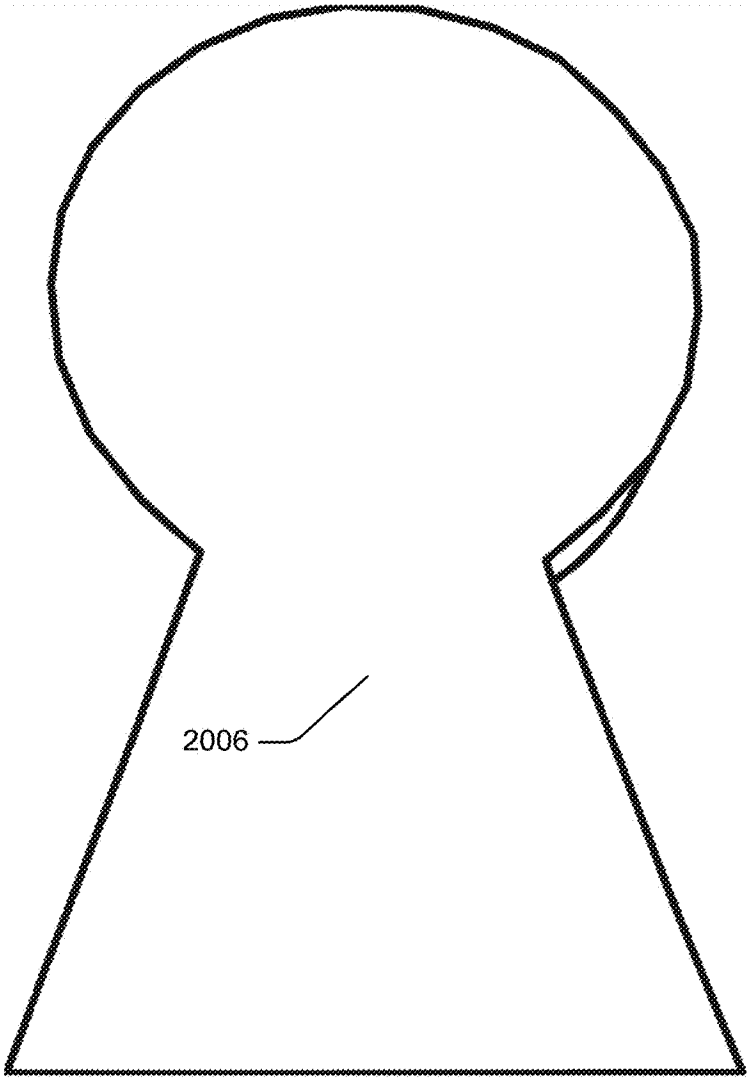
FIG. 20 is a rear perspective view of the construction of the rear of the frame of the dispensing device with the backing covering the frame rear surface.

Referring to FIG. 20, there is shown backing 2006 (pattern 402 of FIG. 4) applied to the frame rear surface 1902 (See FIG. 19).

Figure 21C:
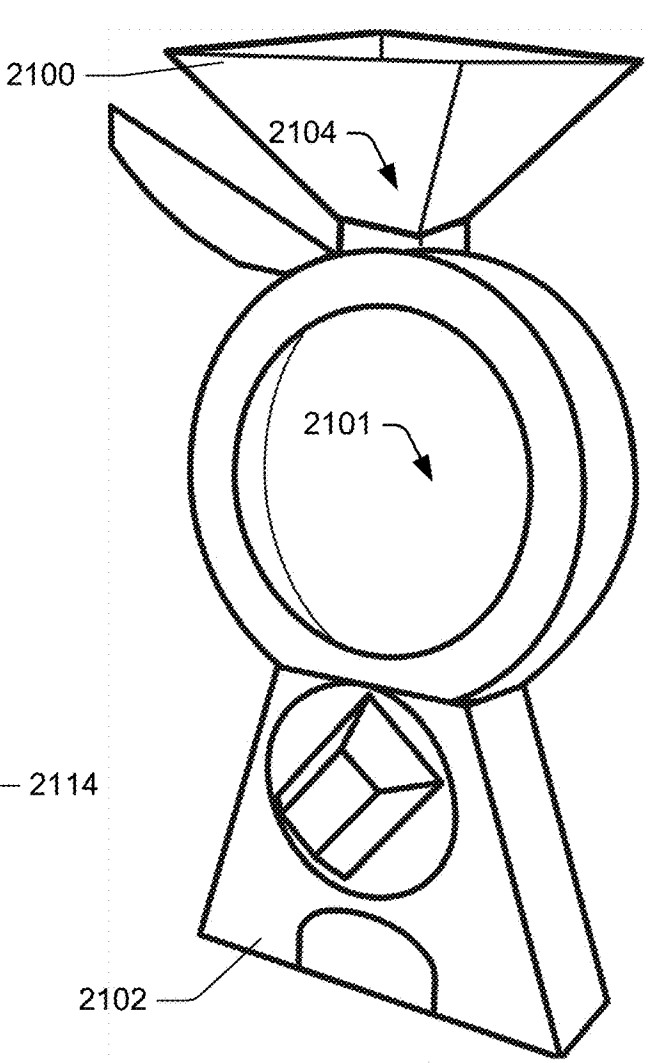
FIGS. 21A-21C are a top perspective views of the construction of funnel used for depositing small objects into the upper chamber of the dispensing device.
Figure 21B:
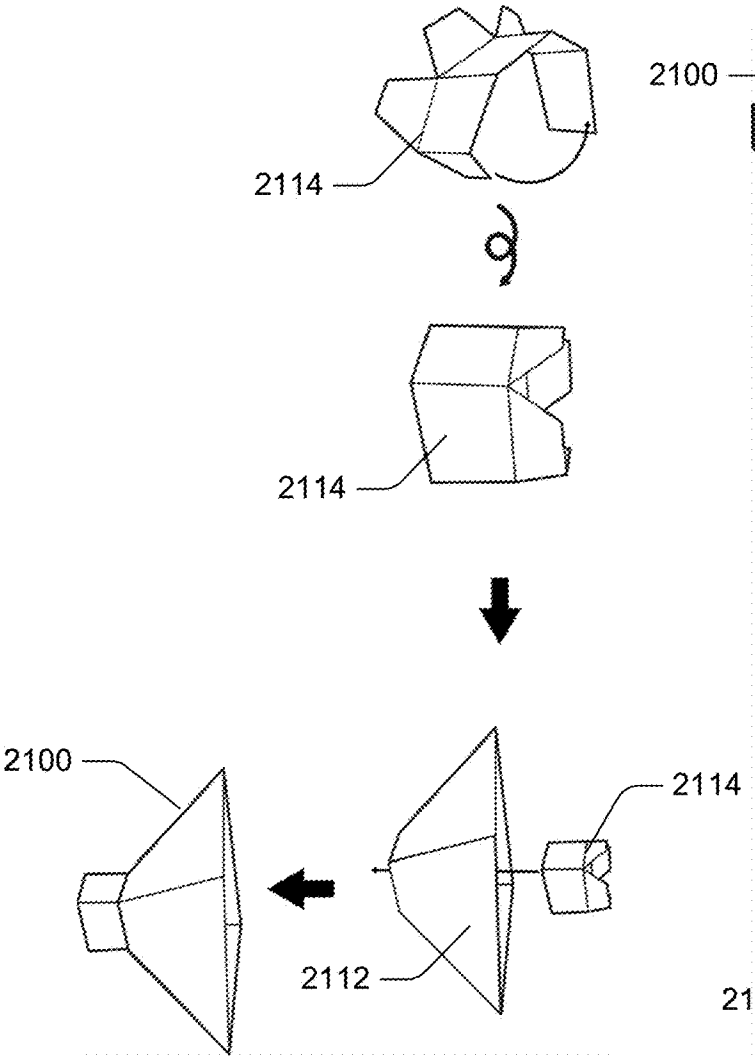
Figure 21A:
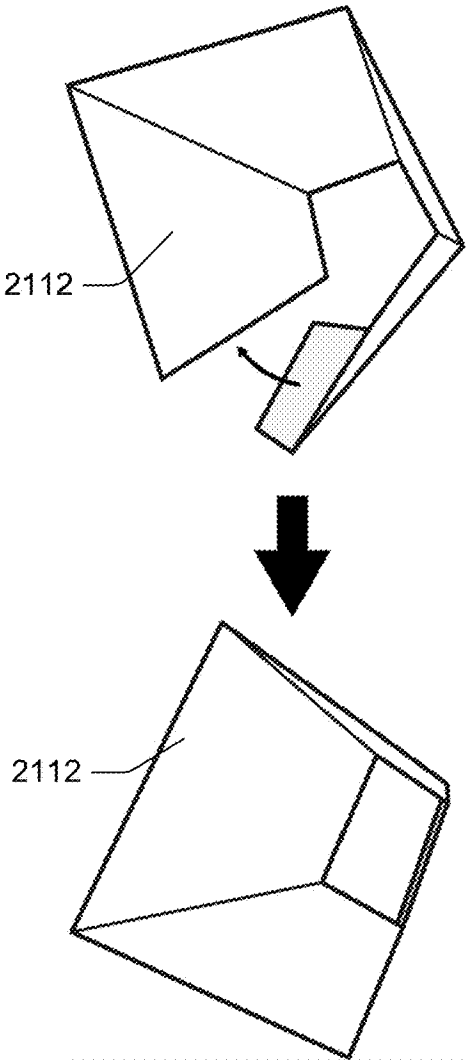

Referring to FIGS. 21A-21C, there is shown the construction of funnel 2100 from patterns 2112 and 2114 (See also 512 and 514 of FIG. 5). Funnel 2100 can be used to deposit small objects 102 (FIG. 1) into the upper chamber 2101 of the dispensing device 2102 through an aperture 2104 in the top of the dispensing device 2102 (FIG. 21C).

Figure 23:
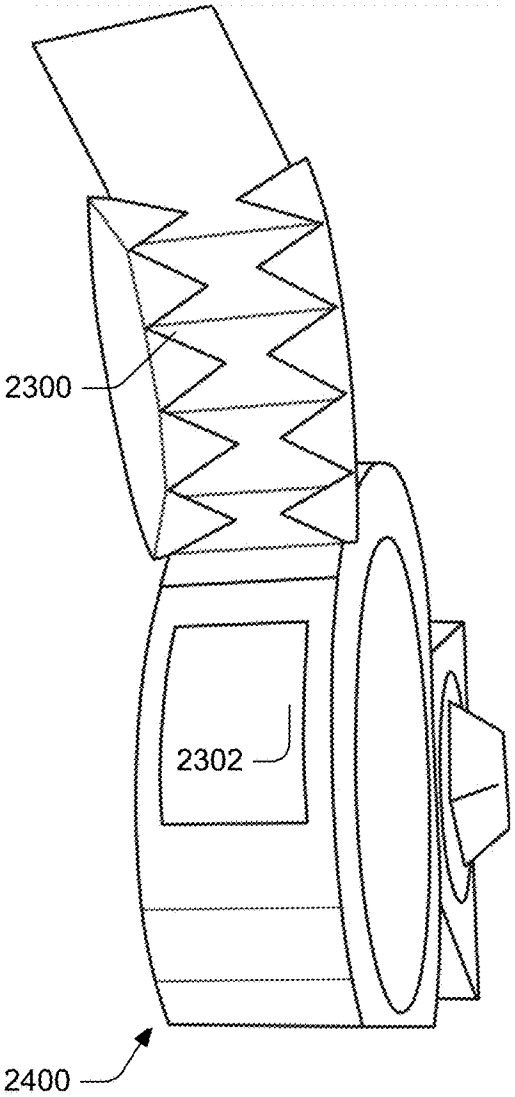
FIGS. 22-23 are a top perspective views of the construction of a covering used to close a hole of the dispensing device through which small objects may be deposited.
Figure 22:
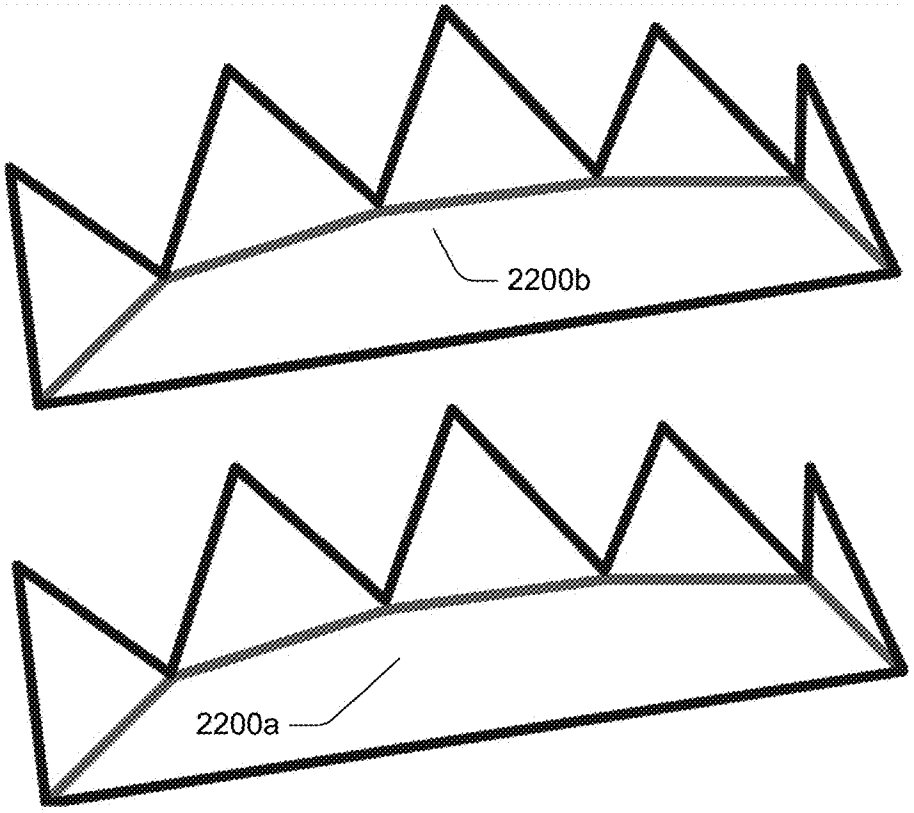

Referring to FIGS. 22-23, there is shown coverings 2200*a* and 2200*b* folded from patterns 602 and 604 and attached with pattern 601 (FIG. 6) to form covering 2300 (FIG. 23). Covering 2300 can be used to cover aperture 2302 of the dispensing device 2400.

While the above detailed description has shown, described and identified several novel features of the invention as applied to a preferred embodiment, it will be understood that various omissions, substitutions and changes in the form and details of the described embodiments may be made by those skilled in the art without departing from the spirit of the invention. Accordingly, the scope of the invention should not be limited to the foregoing discussion but should be defined by the appended claims.

What is claimed is:

1. A method for constructing an apparatus to dispense objects comprising:

providing a frame having a left-side wall, a right-side wall, a front wall and a back wall, the frame enclosing an upper chamber and a lower chamber, and forming opposing apertures on the front wall and the back wall between the upper chamber and the lower chamber;

forming a trough by folding a rectangular sheet of material with a short side and a long side, the rectangular sheet having long edges formed along the long sides and short edges formed along the short sides, the rectangular sheet integrated with a plurality of front tabs extending outward from the rectangular sheet along one of the long edges and with a plurality of rear tabs extending outward from the rectangular sheet along another of the long edges;

providing a first and a second circular disk having an outside surface and an inside surface, the first circular disk having a first plurality of slots that receive the plurality of front tabs on the inside surface of the first circular disk, and the second circular disk having a second plurality of slots that receive the plurality of rear tabs on the inside surface of the second circular disk, the first and second circular disk forming with the trough a rotatable barrel with a barrel chamber having an opening;

connecting a handle to at least one of the first circular disk or the second circular disk outside surface to rotate the rotatable barrel; and disposing the rotatable barrel in the aperture with the first circular disk disposed outside of the front wall and the second circular disk disposed outside of the back wall, wherein the rotatable barrel is rotatable with the handle to a first orientation in which the opening faces upward to receive objects from the upper chamber into the barrel chamber, and wherein the rotatable barrel is rotatable with the handle to a second orientation in which the opening of the barrel chamber faces downward to deposit received objects from the barrel chamber to the lower chamber.

2. The method as recited in claim 1 wherein the rotatable barrel is formed by folding the rectangular sheet of material along multiple score lines extending perpendicular to the long edges.

3. The method as recited in claim 1 further comprising coupling skirts to the frame within the upper chamber to guide objects through the opening in the rotatable barrel from the upper chamber.

4. The method as recited in claim 1 further comprising forming with the front wall an opening within the lower chamber to enable access of received objects deposited from the barrel chamber into the lower chamber.

5. The method as recited in claim 1 further comprising connecting a funnel into the upper chamber to allow a deposit of objects into the upper chamber.

6. An apparatus for dispensing objects comprising:

a frame having a plurality of walls to enclose an upper chamber and a lower chamber, the frame forming an aperture between the upper chamber and the lower chamber, the upper chamber operative to store one or more objects;

a trough formed by continuously folding an elongated sheet of material integrated with a plurality of front tabs extending outward from one edge of the elongated sheet of material and integrated with a plurality of rear tabs extending outward from an opposing edge of the elongated sheet;

a first disk having a first plurality of slots that receive the front tabs, and a second disk having a second plurality of slots that receive the rear tabs, the first and second disk forming with the trough a rotatable barrel with a barrel chamber and an opening;

a handle connected to the first disk to enable manual rotation of the rotatable barrel; and the barrel disposed in the aperture with the first disk disposed outside of one of the walls and the second disk disposed outside another of the walls, wherein the rotatable barrel is operative to orient with the opening facing upward to receive the one or more objects from the upper chamber into the barrel chamber such that when the handle is rotated the rotatable barrel turns to orient the opening downward and deposit objects in the barrel chamber into the lower chamber.

7. The apparatus as recited in claim 6, wherein the frame, the elongated sheet of material, the first disk, the second disk, and the handle are made from paper or cardstock.

8. The apparatus as recited in claim 6, wherein the elongated material has multiple long edges, and wherein the trough formed by continuously folding the elongated sheet of material along multiple lines extending perpendicular to the long edges of the elongated sheet.

9. The apparatus as recited in claim 6 further comprising a plurality of upper skirts connected to the frame within the upper chamber to guide objects through an opening in the rotatable barrel from the upper chamber.

10. The apparatus as recited in claim 6 wherein one of the plurality of walls form an aperture within the lower chamber to enable access of received objects deposited from the barrel chamber into the lower chamber.

11. The apparatus as recited in claim 9 further comprising a plurality of lower skirts connected to the frame within the lower chamber to guide the objects from an opening in the rotatable barrel to the aperture within the lower chamber.

12. A method for dispensing objects comprising:

forming with a plurality of walls of a frame an upper chamber and a lower chamber, and an aperture between the upper chamber and the lower chamber;

creating a folded sheet by continuously folding an elongated sheet of material integrated with a plurality of front tabs extending outward from one edge of the elongated sheet and integrated with a plurality of rear tabs extending outward from an opposing edge of the elongated sheet;

forming a rotatable barrel with a barrel chamber and an opening by receiving the front tabs of the folded sheet with a plurality of slots of a first disk and receiving the rear tabs of the folded sheet with a plurality of slots of a second disk;

connecting a handle to the first disk to enable manual rotation of the rotatable barrel;

disposing the rotatable barrel in the aperture;

depositing objects into the upper chamber;

rotating the handle connected to the first disk to orient the opening of the rotatable barrel upward to receive the objects from the upper chamber into the barrel chamber; and rotating the connected handle to orient opening of the rotatable barrel downward to deposit the objects in the barrel chamber into the lower chamber.

13. The method as recited in claim 12, further comprising forming with the frame an aperture in the lower chamber to enable escape of objects deposited in the lower chamber.

14. The method as recited in claim 12 further wherein rotating the connected handle to orient opening of the rotatable barrel downward to deposit objects in the barrel chamber into the lower chamber includes:

rotating the connected handle about a horizontal axis to orient opening of the rotatable barrel downward.

15. The method as recited in claim 12 wherein disposing the rotatable barrel in the aperture comprises:

disposing the rotatable barrel in the aperture with the first disk disposed outside of the one of the walls and the second disk disposed outside another of the walls.

* * * * *